US010370216B2

(12) United States Patent
Ando et al.

(10) Patent No.: US 10,370,216 B2
(45) Date of Patent: Aug. 6, 2019

(54) IMAGE FORMING APPARATUS

(71) Applicant: CANON KABUSHIKI KAISHA, Tokyo (JP)

(72) Inventors: Yutaka Ando, Toride (JP); Akinobu Nishikata, Matsudo (JP); Takashi Yokoya, Yoshikawa (JP); Akihiro Arai, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 15/661,861

(22) Filed: Jul. 27, 2017

(65) Prior Publication Data

US 2018/0044129 A1 Feb. 15, 2018

(30) Foreign Application Priority Data

Aug. 9, 2016 (JP) ..... 2016-156768

(51) Int. Cl.
*G03G 15/00* (2006.01)
*B65H 31/24* (2006.01)
(Continued)

(52) U.S. Cl.
CPC ..... *B65H 43/04* (2013.01); *B42B 4/00* (2013.01); *B42C 1/12* (2013.01); *B42C 19/02* (2013.01); *B65H 31/24* (2013.01); *B65H 37/04* (2013.01); *B65H 45/18* (2013.01); *G03G 15/5012* (2013.01); *G03G 15/6538* (2013.01); *G03G 15/6582* (2013.01); *B65H 2301/515* (2013.01);
(Continued)

(58) Field of Classification Search
CPC ..... G03G 2215/00552; G03G 2215/00936; B65H 2601/11
See application file for complete search history.

(56) References Cited

U.S. PATENT DOCUMENTS

2014/0241737 A1* 8/2014 Shirasaka ..... G03G 15/6552 399/20
2015/0049356 A1* 2/2015 Saitsu ..... B65H 7/06 358/1.14
(Continued)

FOREIGN PATENT DOCUMENTS

CN 101468765 A 7/2009
CN 103287879 A 9/2013
(Continued)

*Primary Examiner* — Jennifer E Simmons
(74) *Attorney, Agent, or Firm* — Canon U.S.A., Inc. IP Division

(57) ABSTRACT

An image forming apparatus includes an image forming unit to form an image on a sheet, an intermediate processing tray where sheets conveyed through a first conveyance path are stacked as a sheet bundle, a sensor disposed at a second conveyance path to detect a conveyed sheet bundle, and a stacking tray in which sheets discharged through a discharging path diverging from the first conveyance path are stacked. In response to a sensor detected paper jam, a control unit determines the intermediate processing tray as the discharging destination for a sheet among the remaining sheets, and determines the stacking tray as the discharging destination for a sheet among the remaining sheets. After the paper jam is cleared, the control unit causes execution of bookbinding and cutting for a sheet bundle including the remaining sheets stacked in the intermediate processing tray.

7 Claims, 17 Drawing Sheets

(51) Int. Cl.

| | |
|---|---|
| ***B65H 43/04*** | (2006.01) |
| ***B42B 4/00*** | (2006.01) |
| ***B65H 37/04*** | (2006.01) |
| ***B42C 1/12*** | (2006.01) |
| ***B42C 19/02*** | (2006.01) |
| ***B65H 45/18*** | (2006.01) |

(52) U.S. Cl.
CPC .... *B65H 2511/51* (2013.01); *B65H 2511/528* (2013.01); *B65H 2601/11* (2013.01); *B65H 2701/13214* (2013.01); *B65H 2801/21* (2013.01); *B65H 2801/27* (2013.01); *G03G 15/70* (2013.01); *G03G 2215/00814* (2013.01); *G03G 2215/00848* (2013.01); *G03G 2215/00936* (2013.01)

(56) References Cited

U.S. PATENT DOCUMENTS

| | | | | |
|---|---|---|---|---|
| 2015/0321870 | A1 | 11/2015 | Okamoto | |
| 2017/0023901 | A1* | 1/2017 | Asakawa ..... | G03G 15/70 |

FOREIGN PATENT DOCUMENTS

| | | | |
|---|---|---|---|
| CN | 104003240 | A | 8/2014 |
| CN | 104149498 | A | 11/2014 |
| CN | 105565052 | A | 5/2016 |
| CN | 105711270 | A | 6/2016 |
| JP | 2009-203067 | A | 9/2009 |
| JP | 2014-164011 | A | 9/2014 |

* cited by examiner

FIG.2A

FORMAT OF SHEET INFORMATION NOTIFICATION PROVIDED BY IMAGE FORMING APPARATUS

| |
|---|
| SHEET ID |
| SHEET WIDTH [mm] |
| SHEET LENGTH [mm] |
| BASIS WEIGHT [gsm] |
| SHEET TYPE |
| POST PROCESSING MODE |
| CUTTING AMOUNT [mm] |
| BUNDLE LEADING SHEET INFORMATION |
| BUNDLE LAST SHEET INFORMATION |
| ⋮ |

FIG.2B

FORMAT OF SHEET INFORMATION NOTIFICATION STORED BY FINISHER

| |
|---|
| SHEET ID |
| SHEET WIDTH [mm] |
| SHEET LENGTH [mm] |
| BASIS WEIGHT [gsm] |
| SHEET TYPE |
| POST PROCESSING MODE |
| BUNDLE LEADING SHEET INFORMATION |
| BUNDLE LAST SHEET INFORMATION |
| ESCAPE INFORMATION |
| ⋮ |

FIG.12

The stacking order of the removed bundle and the bundle in the saddle stitching tray can change.

If you do not want to change the stacking order, remove the bundle in the saddle stitching tray, and then press “Resume”.

Resume

IMAGE FORMING APPARATUS

BACKGROUND OF THE INVENTION

Field of the Invention

The disclosed information relates to an image forming apparatus.

Description of the Related Art

There have been known image forming apparatuses that each form an image on a sheet and perform predetermined post processing on the sheet. Further, among the image forming apparatuses, one type of image forming apparatus forms sheet bundles by stacking a plurality of sheets conveyed from an image forming unit onto a saddle stitching tray provided in a post processing apparatus. The image forming apparatus then conveys the sheet bundles one by one, and performs post processing such as cutting on each of the sheet bundles.

The post processing apparatus has multiple functions these days. Therefore, one type of post processing apparatus has sheet discharge trays that are different according to the type of post processing, and this type of post processing apparatus has become widespread.

Japanese Patent Application Laid-Open No. 2014-164011 discusses a method for reducing steps for jam clearing performed when a paper jam occurs in a post processing apparatus. In this method, when a paper jam occurs, printed sheets remaining upstream from a jam occurrence point in a conveyance direction are ejected to one sheet discharge tray.

SUMMARY OF THE INVENTION

The disclosed information is directed to a unit for reducing sheets to be wasted by occurrence of a paper jam.

According to an aspect of the present invention, an image forming apparatus includes an image forming unit configured to form an image on a sheet, a first conveyance path for conveying the sheet on which the image is formed by the image forming unit, an intermediate processing tray in which a plurality of sheets conveyed through the first conveyance path is stacked as a sheet bundle, a bookbinding unit configured to execute bookbinding for the sheet bundle stacked in the intermediate processing tray, a second conveyance path for conveying the sheet bundle after the bookbinding is performed for the sheet bundle by the bookbinding unit, a cutting unit configured to cut the sheet bundle conveyed in the second conveyance path, a sensor disposed at the second conveyance path and configured to detect a sheet bundle being conveyed in the second conveyance path, a stacking tray in which sheets discharged through a discharging path diverging from the first conveyance path are stacked, and a control unit configured to determine a discharging destination of sheets remaining in the first conveyance path, wherein, in response to occurrence of a paper jam based on detection information from the sensor, the control unit determines the intermediate processing tray as the discharging destination, for a sheet to be included in a same bundle as a bundle of sheets stacked in the intermediate processing tray among the remaining sheets, and determines the stacking tray as the discharging destination, for a sheet to be included in a bundle different from the bundle of the sheets stacked in the intermediate processing tray among the remaining sheets, and wherein, after the paper jam is cleared, the control unit causes execution of bookbinding and cutting for a sheet bundle including the remaining sheets stacked in the intermediate processing tray.

Further features of the present invention will become apparent from the following description of embodiments with reference to the attached drawings.

BRIEF DESCRIPTION OF THE DRAWINGS

FIGS. 2A and 2B each illustrate a format of sheet information.

FIG. 12 illustrates a display screen of the operation display device.

DESCRIPTION OF THE EMBODIMENTS (Overall Configuration)

Figure 1:
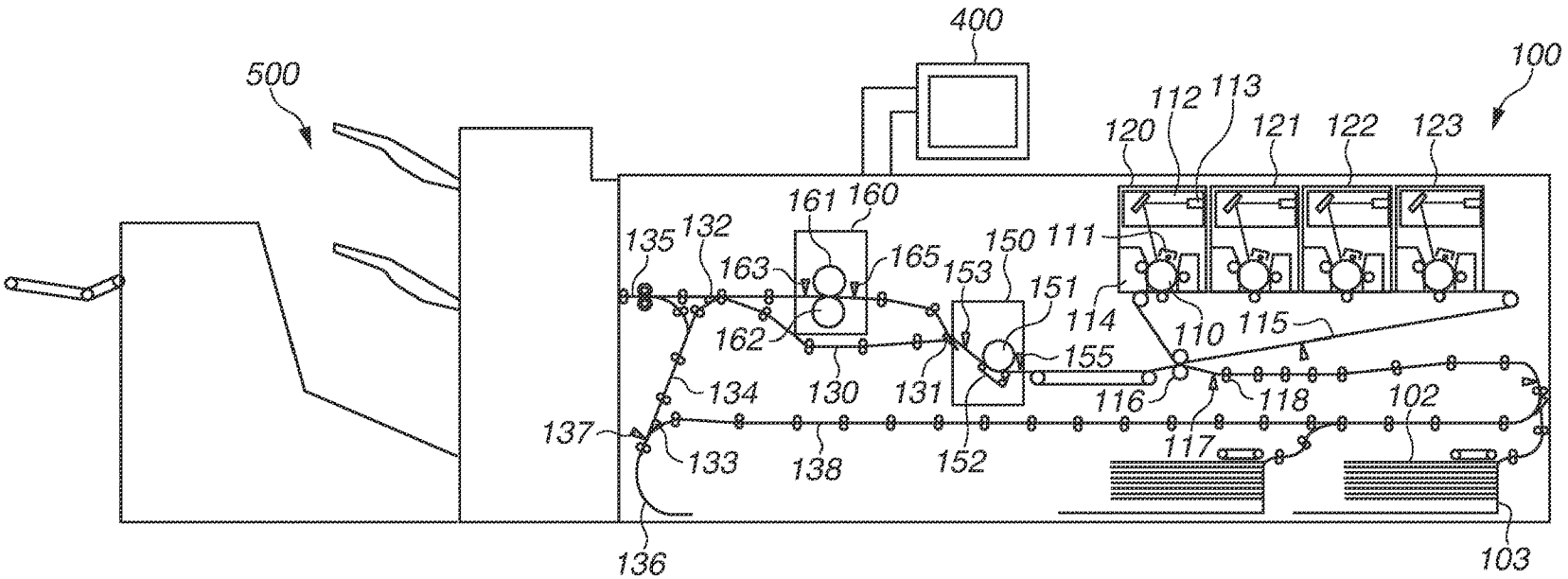
FIG. 1 is an overall view of an image forming system.

FIG. 1 is a diagram illustrating a longitudinal section structure of a main part of an image forming system according to a first embodiment. The image forming system includes an image forming apparatus 100 and a finisher 500 as illustrated in FIG. 1.

(Image Forming Apparatus)

A sheet fed from a sheet storage case 103 provided in the image forming apparatus 100 is conveyed to a registration sensor 117. When the sheet arrives at the registration sensor 117, sheet information illustrated in FIG. 2A is transmitted to the finisher 500 that is a post processing apparatus. The sheet information is information about a sheet. The finisher 500 stores the received sheet information. The sheet information includes a paper size, a basis weight, a sheet material type, and a post processing mode. FIG. 2A illustrates a format of the sheet information transmitted by the image forming apparatus 100, and FIG. 2B illustrates a format of the sheet information stored in the finisher 500.

The image forming apparatus 100 has four stations 120, 121, 122, and 123 corresponding to YMCK. The stations 120, 121, 122, and 123 are each an image forming unit that forms an image by transferring toner to a sheet. YMCK stands for yellow, magenta, cyan, and black. A photosensitive drum 110 serving as an image carrier is charged at a uniform surface potential by a primary charger 111. On the photosensitive drum 110, a latent image is formed by a laser beam output by a laser 113. A developing device 114 forms a toner image by developing the latent image by using a color material (toner). The toner image (a visible image) is transferred to an intermediate transfer member 115. The visible image formed on the intermediate transfer member 115 is transferred by a transfer roller 116 to the sheet conveyed from the sheet storage case 103.

A fixing mechanism includes a first fixing unit 150 and a second fixing unit 160 each provided to fix the toner image transferred to the sheet by applying heat and pressure. The first fixing unit 150 has a fixing roller 151, a pressing belt 152, and a sensor 153 after the first fixing. The fixing roller 151 is provided to apply heat to the sheet. The pressing belt 152 is provided to bring the sheet into pressure contact with the fixing roller 151. The sensor 153 is provided to detect completion of fixing. The fixing roller 151 is a hollow roller and has a heater therein.

The second fixing unit 160 is disposed downstream from the first fixing unit 150 in a sheet conveyance direction. The second fixing unit 160 is used to apply a gloss (shine) to the toner image fixed onto the sheet by the first fixing unit 150. Further, the second fixing unit 160 is used to supplement a heat amount, which is insufficient for a sheet of a large basis weight that needs a large amount of heat as represented by thick paper, if only the first fixing unit 150 is used. The second fixing unit 160 has a fixing roller 161, a pressing roller 162, and a sensor 163 after the second fixing. These rollers are each a hollow roller and each have a heater therein. It is not necessary to go through the second fixing unit 160, depending on the type of sheet. In this case, the sheet runs in a conveyance path 130 while bypassing the second fixing unit 160, in order to reduce energy consumption.

For example, in a case where giving a large amount of gloss to a sheet is set, or in a case where a large amount of heat is necessary for fixing to a sheet represented by thick paper, the sheet after passing through the first fixing unit 150 is conveyed to the second fixing unit 160. In contrast, in a case where the sheet is plain paper or thin paper and giving a large amount of gloss is not set, the sheet is conveyed in the conveyance path 130 while bypassing the second fixing unit 160. Whether the sheet is conveyed to the second fixing unit 160 or conveyed while bypassing the second fixing unit 160 is controlled by switching of a diverter 131.

A conveyance path diverter 132 is a guiding member that guides a sheet to a conveyance path 134 or to a discharging path 135 for discharge to outside. The leading end of the sheet guided to the conveyance path 134 is conveyed to a reverse portion 136 via a reverse sensor 137. When the reverse sensor 137 detects the rear end of the sheet, the sheet conveyance direction is changed. A conveyance path diverter 133 is a guiding member that guides the sheet to a conveyance path 138 for two-sided image formation, or to the discharging path 135.

The sheet guided to the discharging path 135 and then discharged from the image forming apparatus 100 is sent to the finisher 500. A configuration of the finisher 500 will be described below with reference to FIG. 5.

(Overall System Block Diagram)

Figure 3:
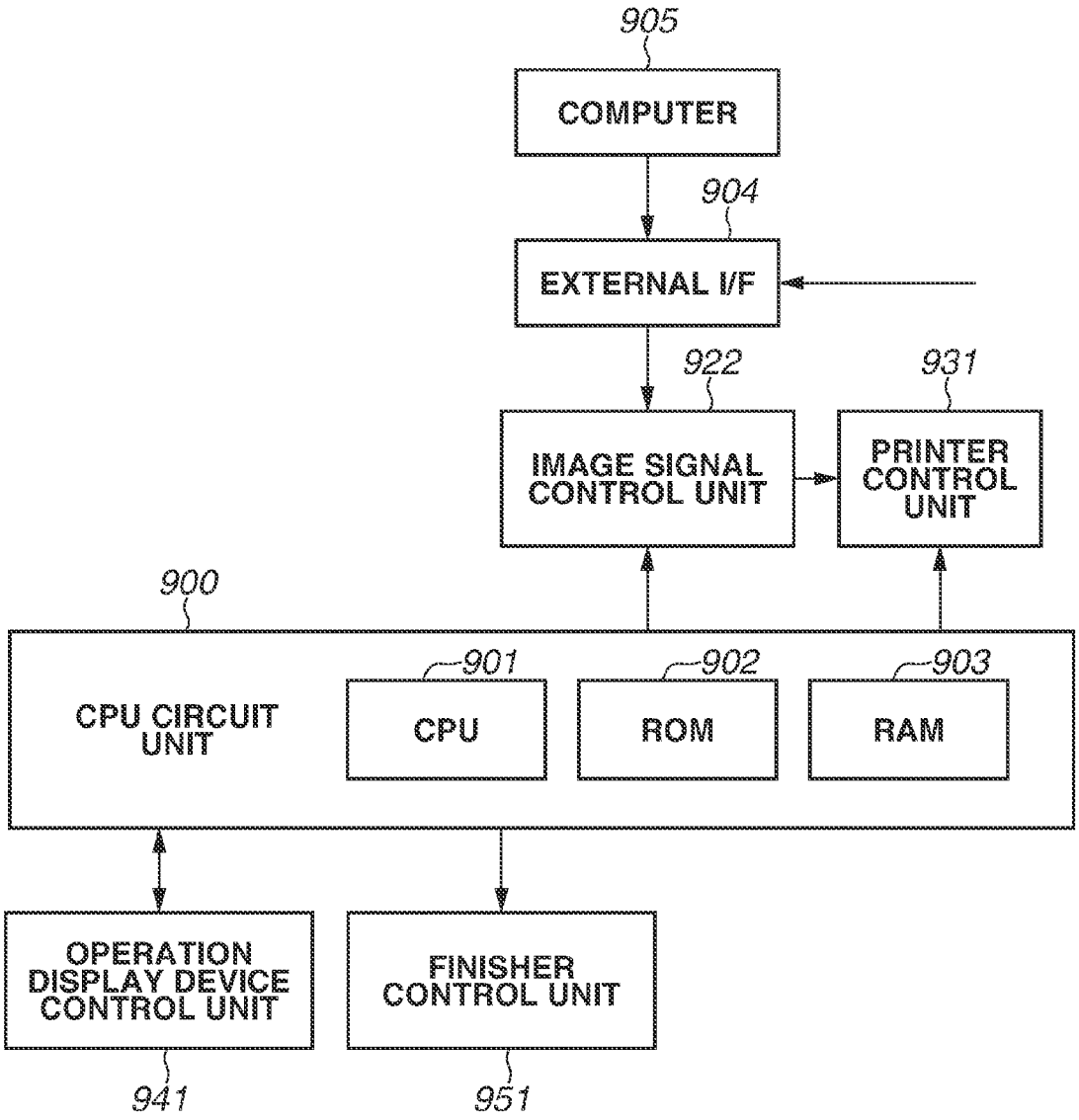
FIG. 3 is a system block diagram of the image forming system.

FIG. 3 is a block diagram illustrating a configuration of a controller for controlling the image forming system illustrated in FIG. 1.

The controller has a central processing unit (CPU) circuit unit 900. The CPU circuit unit 900 has a CPU 901, a read only memory (ROM 902), and a random access memory (RAM) 903. The CPU 901 is a processor that performs basic control of the image forming system. A control program to be executed by the CPU 901 is written in the ROM 902. The RAM 903 temporarily holds control data. The RAM 903 is used as a work area for arithmetic processing involved in control. The CPU 901, the ROM 902, and the RAM 903 are connected via an address bus and a data bus. The CPU 901 controls each of an image signal control unit 922, an external I/F 904, a printer control unit 931, an operation display device control unit 941, and a finisher control unit 951, by using the control program stored in the ROM 902.

The image signal control unit 922 performs various kinds of processing on a digital image signal input from a computer 905 via the external I/F 904. The image signal control unit 922 then converts the digital image signal into a video signal and outputs the video signal to the printer control unit 931. The printer control unit 931 controls the image forming apparatus 100 based on the video signal output from the image signal control unit 922, thereby performing image formation and sheet conveyance. The CPU circuit unit 900 controls processing operation of the image signal control unit 922 and the printer control unit 931.

The finisher control unit 951 is provided in the finisher 500. The finisher control unit 951 controls the finisher 500 by exchanging information with the CPU circuit unit 900. The content of this control will be described below.

The operation display device control unit 941 allows exchange of information between an operation unit 400 and the CPU circuit unit 900. The operation unit 400 includes a plurality of keys for setting various functions related to image formation. The operation unit 400 further includes a display portion for displaying information that indicates a set state. The operation display device control unit 941 outputs a key signal corresponding to operation performed on each of the keys to the CPU circuit unit 900. Further, based on a signal from the CPU circuit unit 900, the operation display device control unit 941 causes the operation unit 400 to display information corresponding to the signal.

(Operation Display Device)

Figure 4A:
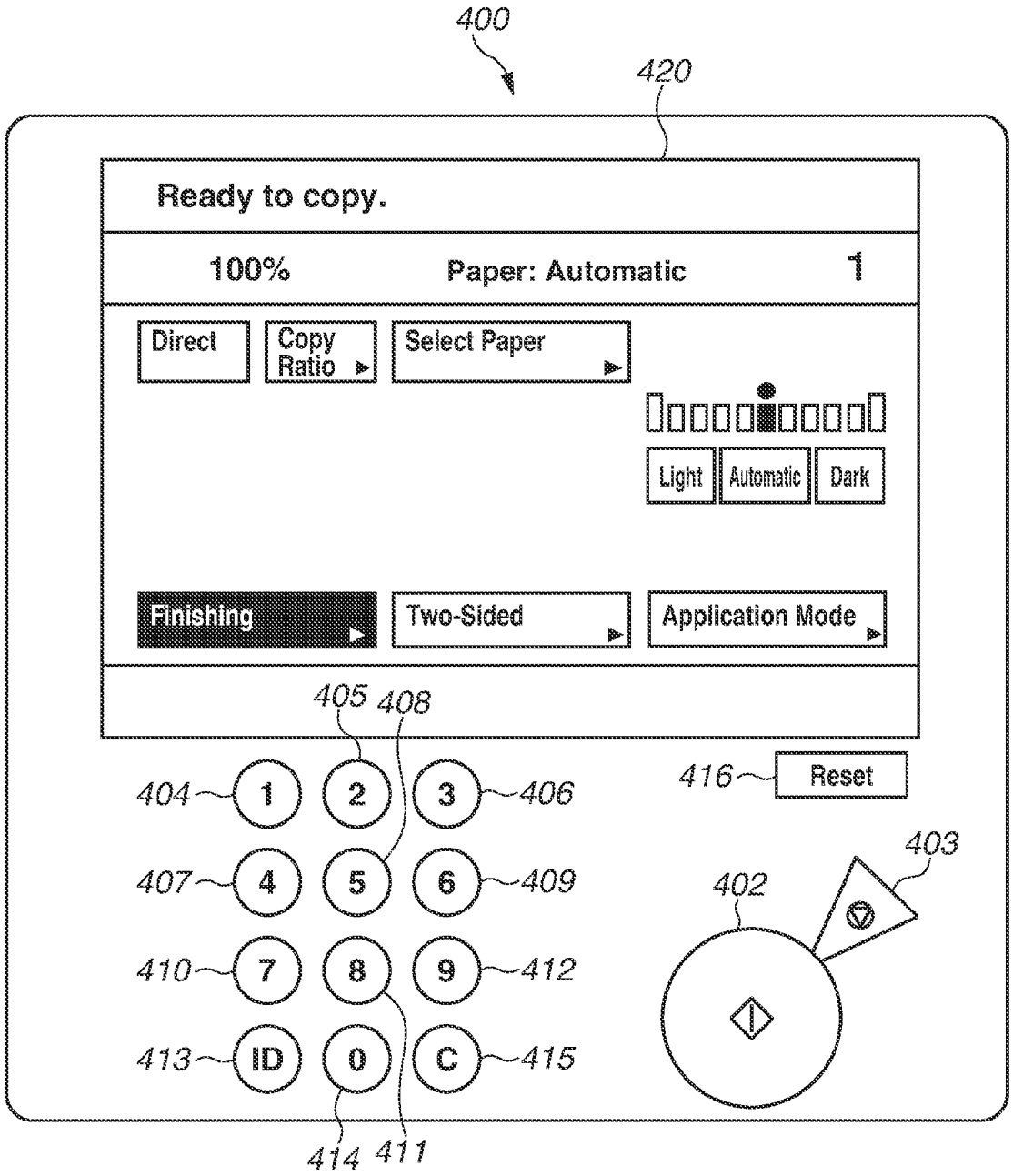
FIGS. 4A, 4B, and 4C are explanatory drawings of an operation display device.

FIG. 4A is a schematic diagram illustrating the operation unit 400. A start key 402 for starting image forming operation and a stop key 403 for stopping the image forming operation are arranged in the operation unit 400. Further, a numeric keypad, an identification (ID) key 413, a clear key 415, and a reset key 416 are arranged in the operation unit 400. The numeric keypad includes keys 404 to 412 and 414 for operation such as setting of the number of copies. Disposed on an upper part of the operation unit 400 is a display portion 420 to which a touch panel is attached. In the display portion 420, soft keys are displayed on a screen.

The image forming apparatus 100 has processing modes such as a non-sorting mode, a sorting mode, a staple sorting mode (a binding mode), a bookbinding mode, as post processing modes. Such processing modes are set by input operation from the operation unit 400. For example, in setting the post processing mode, when a soft key indicating "finishing" is selected in the initial screen illustrated in FIG. 4A, a menu selection screen illustrated in FIG. 4B appears in the display portion 420. The processing mode is set using this menu selection screen.

Figure 4B:
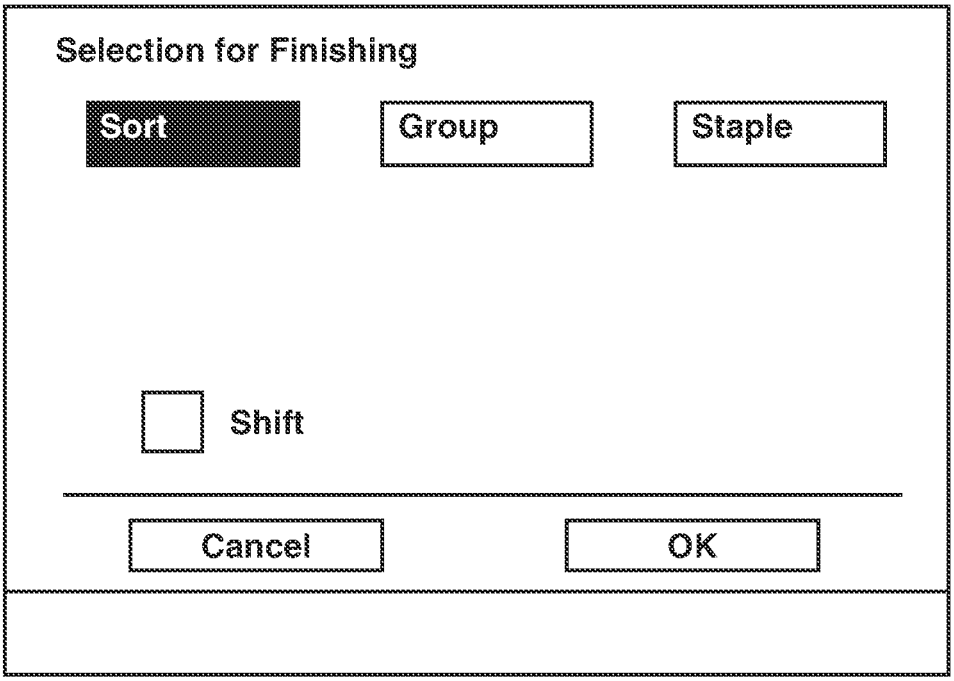
Figure 4C:
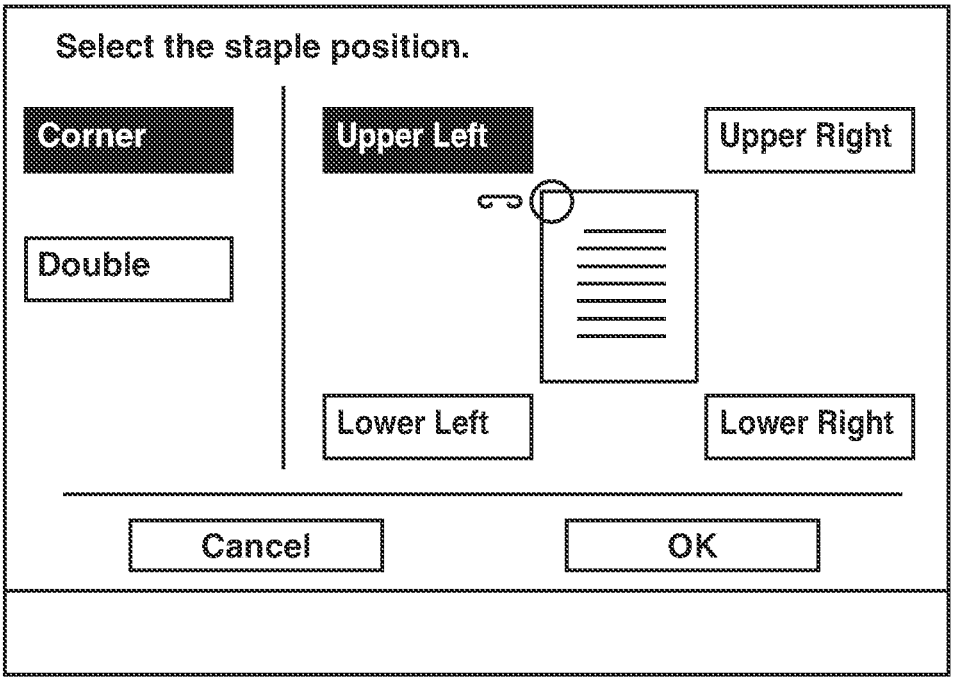

Here, assume that a user ends selection for finishing, in a state that a soft key indicating "sort" is selected in FIG. 4B. In this case, the sorting mode is set. Alternatively, when the user presses a soft key indicating "staple", a staple setting screen illustrated in FIG. 4C appears in the display portion 420. Then, the user can select any of binding ways such as corner binding and two-position binding.

(Finisher)

Figure 5:
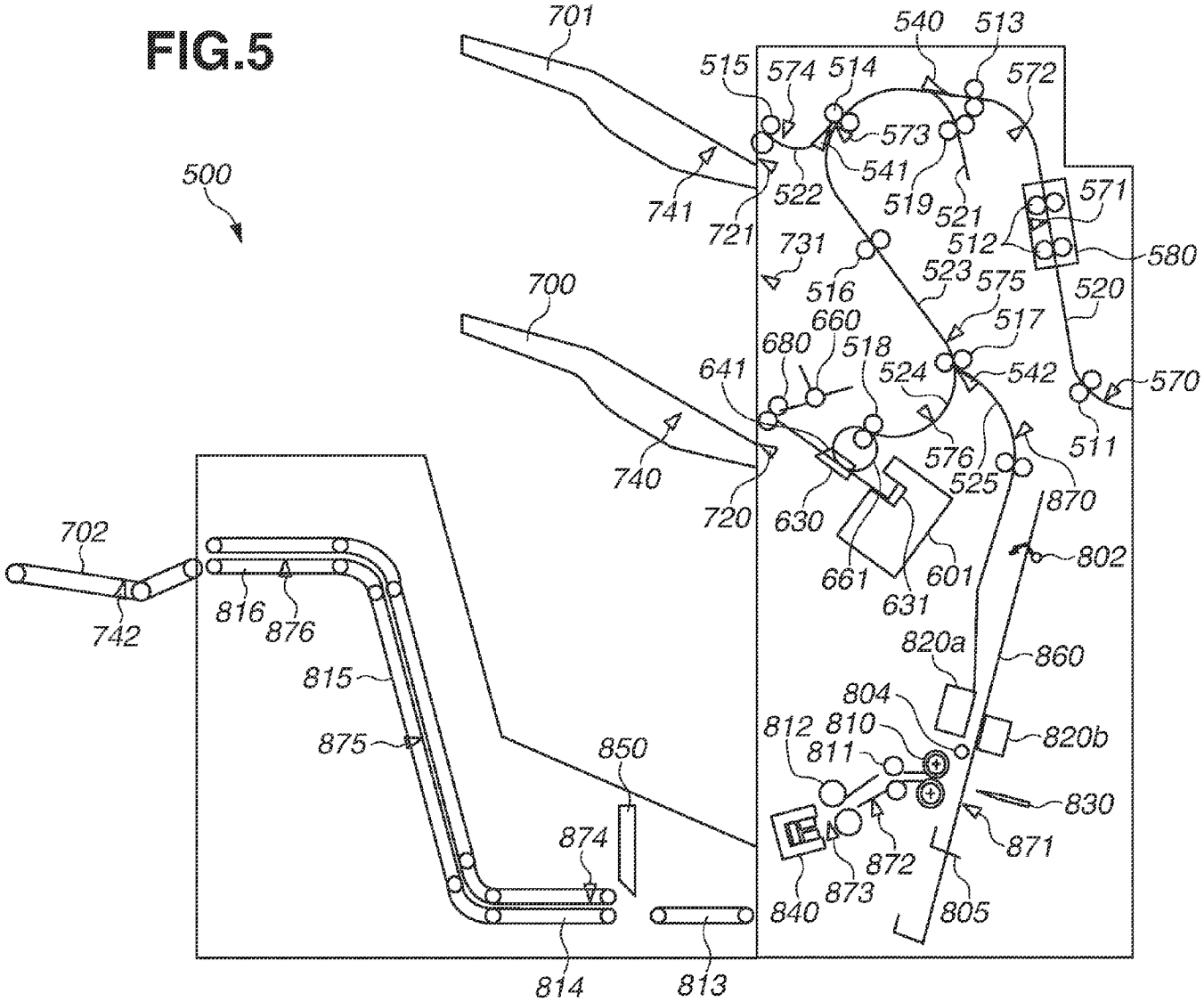
FIG. 5 is a cross-sectional diagram of a post processing apparatus.
Figure 6:
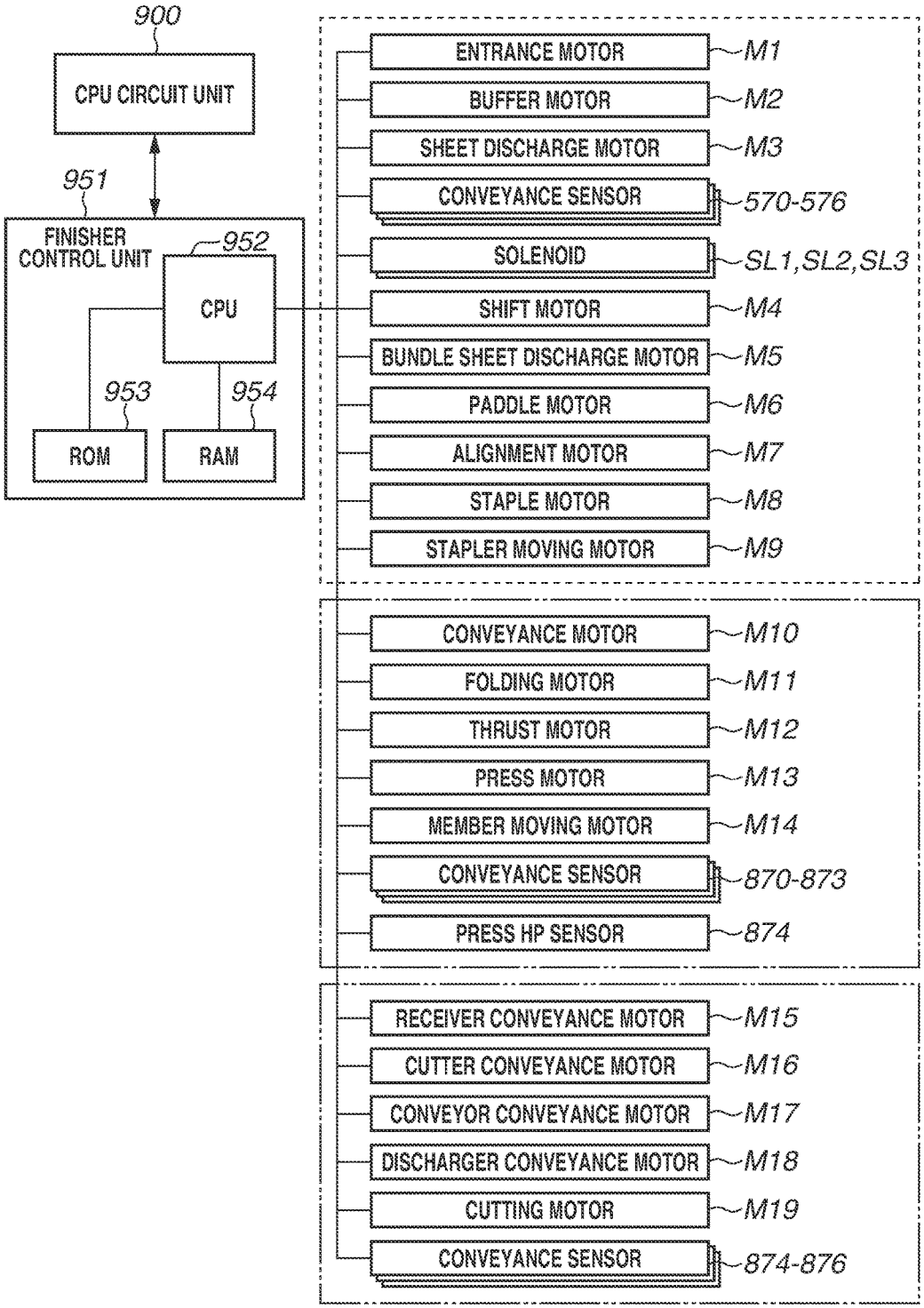
FIG. 6 is a system block diagram of the post processing apparatus.

The configuration of the finisher 500 will be described with reference to FIGS. 5 and 6. FIG. 5 is a block diagram of the finisher 500. FIG. 6 is a block diagram of the finisher control unit 951 that performs drive control of the finisher 500.

First, FIG. 5 will be described. The finisher 500 can sequentially receive sheets discharged from the image forming apparatus 100, and form a sheet bundle by aligning the received sheets. Further, the finisher 500 can bind the rear end of the sheet bundle by stapling. Furthermore, the finisher 500 can perform post processing, such as bookbinding for folding the sheet bundle in two at the center, and cutting of the sheet bundle. In addition, glue binding for the sheet bundle may be performed. A post processing unit to be described below executes the post processing.

In the finisher 500, a conveyance roller pair 511 takes a sheet discharged from the image forming apparatus 100, into a conveyance path 520. The sheet taken by the conveyance roller pair 511 into the inside is sent via conveyance roller pairs 512 and 513. On the conveyance path 520, conveyance sensors 570, 571, and 572 are provided to each detect the passage of the sheet.

The conveyance roller pair 512 is provided in a shift unit 580 together with the conveyance sensor 571. A shift motor M4 to be described below can move the shift unit 580 in a sheet widthwise direction orthogonal to the conveyance direction. When driven in a state that the sheet is pinched by the conveyance roller pair 512, the shift motor M4 can offset the sheet in the widthwise direction while the sheet is conveyed. In the sorting mode, which is set when the user selects a soft key indicating "shift" in FIG. 4B, a sheet to be shifted frontward is offset frontward by 15 mm, whereas a sheet to be shifted rearward is offset rearward by 15 mm. In a case where the "shift" is not selected, the sheet is allowed to pass without being offset.

When the sheet having passed the shift unit 580 is detected based on an input of the conveyance sensor 571, the shift motor M4 is driven to return the shift unit 580 to the center position.

Between the conveyance roller pair 513 and a conveyance roller pair 514, a reverse diverter 540 is disposed to guide a sheet to a buffer path 521. The sheet is reversed and conveyed by a conveyance roller pair 519.

An upper paper ejection path 522 is a discharging path diverging from a first conveyance path. The upper paper ejection path 522 is provided between the conveyance roller pair 514 and a conveyance roller pair 515. Further, between the conveyance roller pairs 514 and 515, a diverter 541 is disposed to switch between conveyance of a sheet to the upper paper ejection path 522 and conveyance of a sheet to a lower paper ejection path 523.

When the diverter 541 is switched to the upper paper ejection path 522 side, the conveyance roller pair 514 driven by a buffer motor M2 to be described below guides the sheet to the upper paper ejection path 522. The sheet guided to the upper paper ejection path 522 is discharged to an upper tray 701 by the conveyance roller pair 515 driven by a sheet discharge motor M3. A conveyance sensor 574 is provided on the upper paper ejection path 522 to detect the passage of the sheet.

Escaping is performed for a sheet set as an escape sheet. In a case where the escaping is performed, the diverter 541 is switched to the upper paper ejection path 522 side, to guide a sheet remaining in the system to the upper paper ejection path 522.

When the diverter 541 is switched to the lower paper ejection path 523 side, the conveyance roller pair 514 driven by the buffer motor M2 guides a sheet to the lower paper ejection path 523. The sheet is then conveyed by a conveyance roller pair 516 driven by the sheet discharge motor M3. A conveyance sensor 575 is provided on the lower paper ejection path 523 to detect the passage of the sheet.

Disposed downstream from the lower paper ejection path 523 is a diverter 542 for switching between a lower paper ejection path 524 and a bookbinding path 525. When the diverter 542 is switched to the lower paper ejection path 524 side, a sheet is guided to a processing tray 630, by conveyance roller pairs 517 and 518 driven by the sheet discharge motor M3 to be described below. A conveyance sensor 576 is provided on the lower paper ejection path 524 to detect the passage of the sheet.

In a case where "staple" in FIG. 4B is selected by the user, a sheet is discharged to the upper tray 701. When "staple" is not selected, a bundle ejection roller pair 680 driven by a bundle sheet discharge motor M5 not illustrated in FIG. 5 discharges a sheet to a lower tray 700.

When the diverter 542 is switched to the bookbinding path 525 side, a sheet is guided to the bookbinding path 525 by the conveyance roller pair 517 driven by the sheet discharge motor M3 to be described below and a conveyance roller pair 801 driven by a conveyance motor M10 to be described below. The sheet guided to the bookbinding path 525 is conveyed to a saddle stitching tray 860 (an intermediate processing tray) via the conveyance roller pair 801. A conveyance sensor 870 is provided on the bookbinding path 525 to detect the passage of the sheet.

A plurality of sheets conveyed to the saddle stitching tray 860 is formed as a sheet bundle. A sheet gripping member 802, a sheet positioning member 804 that is movable, and a leading end alignment member 805 are provided in the saddle stitching tray 860 (the intermediate processing tray). Further, a saddle stapler 820*a* and an anvil 820*b* are provided. The anvil 820*b* is disposed at a position facing the saddle stapler 820*a*. The saddle stapler 820*a* is an example of the post processing unit. The saddle stapler 820*a* and the anvil 820*b* are configured to be able to perform stapling for the sheet bundle stored in the saddle stitching tray 860 (the intermediate processing tray), by operating together.

Bookbinding operation to be described below is performed for the sheet bundle after the stapling. A folding roller pair 810 and a thrust member 830 are provided downstream from the saddle stapler 820*a*. The folding roller pair 810 is driven by the conveyance motor M10. The thrust member 830 is disposed at a position facing the folding roller pair 810 and driven by a thrust motor M12. The sheet bundle stored in the saddle stitching tray 860 is pushed into a part between the folding roller pair 810, by thrusting the thrust member 830 to the sheet bundle stored in the saddle stitching tray 860 (the intermediate processing tray). Subsequently, pressing is performed for the sheet bundle folded by the folding roller pair 810. First, the folded sheet bundle is passed via the folding roller pair 810 to folding conveyance roller pairs 811 and 812 driven by a folding motor M11. The sheet bundle is stopped, after being conveyed by a predetermined amount, following detection of the leading end of the sheet bundle by a bundle sheet discharge sensor 873 for stopping the sheet bundle at a press position. A saddle press 840 is then driven by a press motor M13 to press the folded part of the sheet bundle. Subsequently, the folding conveyance roller pairs 811 and 812 are driven to discharge the sheet bundle to a trimmer.

The trimmer has a receiver conveyance belt 813 driven by a receiver conveyance motor M15, and a cutter conveyance belt 814 driven by a cutter conveyance motor M16. The trimmer conveys the sheet bundle until a conveyance sensor 874 detects the sheet bundle. When the sheet bundle is detected by the conveyance sensor 874, the trimmer conveys the sheet bundle for a predetermined distance and then stops the conveyance. The sheet bundle is then cut by a cutting blade 850 (a cutting unit) driven by a cutting motor M19. Next, the cutter conveyance belt 814, a conveyor conveyance belt 815, and a discharger conveyance belt 816 convey the sheet bundle. The sheet bundle is then discharged to a stacking tray 702.

(Finisher Block Diagram)

Next, a configuration of the finisher control unit 951 that performs drive control of the finisher 500 will be described with reference to FIG. 6. FIG. 6 is a block diagram illustrating the configuration of the finisher control unit 951 illustrated in FIG. 3.

The finisher control unit 951 includes a CPU 952, a ROM 953, and a RAM 954, as illustrated in FIG. 6. The finisher control unit 951 exchanges data with the CPU circuit unit 900 provided in the image forming apparatus 100. The finisher control unit 951 communicates with the CPU circuit unit 900, via a communication integrated circuit (IC) not illustrated. The finisher control unit 951 performs the drive control of the finisher 500, by executing various programs stored in the ROM 953, based on instructions from the CPU circuit unit 900.

An entrance motor M1 drives the conveyance roller pairs 511, 512, and 513. The buffer motor M2 drives the conveyance roller pairs 514 and 519. The sheet discharge motor M3 drives the conveyance roller pairs 515, 516, 517, and 518. The shift motor M4 drives the shift unit 580. Further, the bundle sheet discharge motor M5, a paddle motor M6, an alignment motor M7, a staple motor M8, and a stapler moving motor M9 are provided as devices for driving various members of the post processing apparatus. The bundle sheet discharge motor M5 drives a bundle sheet discharge roller 680. The paddle motor M6 drives a paddle 660. The alignment motor M7 drives an alignment member 641. The staple motor M8 drives a stapler 601 that binds a sheet bundle. The stapler moving motor M9 moves the stapler 601 in a direction perpendicular to the conveyance direction along the outer periphery of the processing tray 630. Further, sensors such as the conveyance sensors 570 to 576 each provide an input signal when detecting the passage of a sheet being conveyed.

Further, solenoids SL1, SL2, and SL3 are provided. The solenoid SL1 drives the reverse diverter 540. The solenoid SL2 drives the diverter 541. The solenoid SL3 drives the diverter 542.

Motors such as the conveyance motor M10, the folding motor M11, the thrust motor M12, the press motor M13, and a member moving motor M14 are provided for inputs and outputs for a bookbinding function. The conveyance motor M10 drives the conveyance roller pair 801. The folding motor M11 drives the folding roller pair 810 as well as the folding conveyance roller pairs 811 and 812. The thrust motor M12 drives the thrust member 830. The press motor M13 drives the saddle press 840. The member moving motor M14 moves the leading end alignment member 805. Further, sensors such as the conveyance sensor 870 to a conveyance sensor 874 are provided. The conveyance sensors 870 to 873 each provide an input signal when detecting the passage of a sheet being conveyed. The conveyance sensor 874 provides an input signal when detecting the home position of the saddle press 840.

The receiver conveyance motor M15, the cutter conveyance motor M16, a conveyor conveyance motor M17, a discharger conveyance motor M18, and the cutting motor M19 are provided for inputs and outputs for a cutting function. The receiver conveyance motor M15 drives the receiver conveyance belt 813. The cutter conveyance motor M16 drives the cutter conveyance belt 814. The conveyor conveyance motor M17 drives the conveyor conveyance belt 815. The discharger conveyance motor M18 drives the discharger conveyance belt 816. The cutting motor M19 drives the cutting blade 850. Further, sensors such as the conveyance sensor 874 as well as conveyance sensors 875 and 876 each provide an input signal when detecting the passage of a sheet bundle being conveyed. In the present embodiment, the cutting function is taken as an example of the post processing for the sheet bundle after the bookbinding. However, flattening the sheet bundle by pressing the rear face of the sheet bundle may be the post processing.

(Setting of Bookbinding Operation)

How the bookbinding mode is set by the operation unit 400 will be described with reference to FIGS. 7A to 7E. The bookbinding mode is set by the user via the operation unit 400. When an "application mode" key is selected by the user in the initial screen illustrated in FIG. 7A, the display in the operation unit 400 changes from the initial screen illustrated in FIG. 7A to an application mode selecting screen illustrated in FIG. 7B.

Figure 7A:
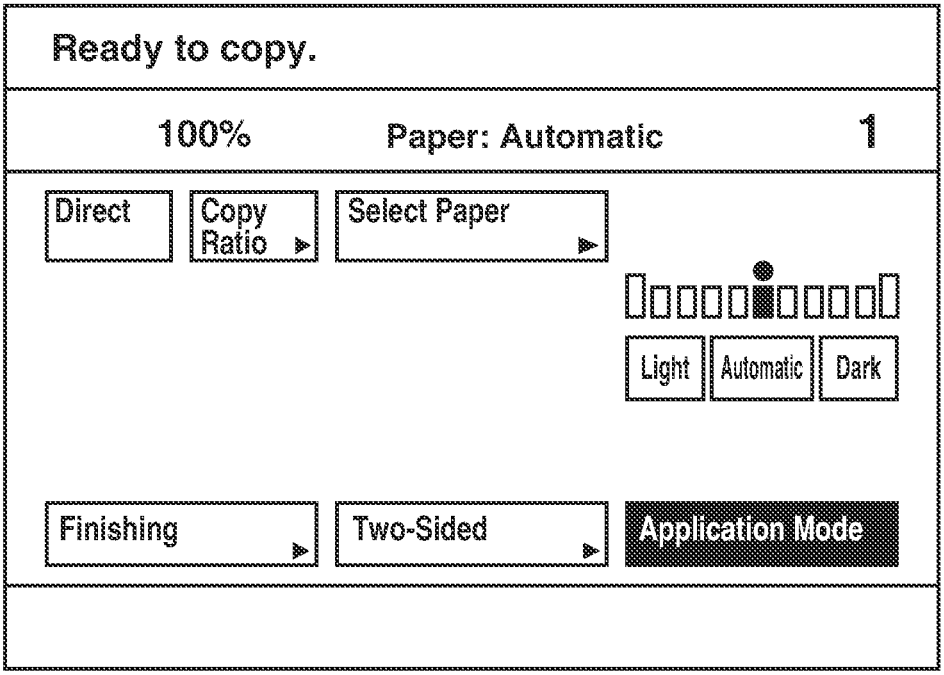
FIGS. 7A, 7B, 7C, 7D, and 7E each illustrate a setting screen for bookbinding.
Figure 7B:
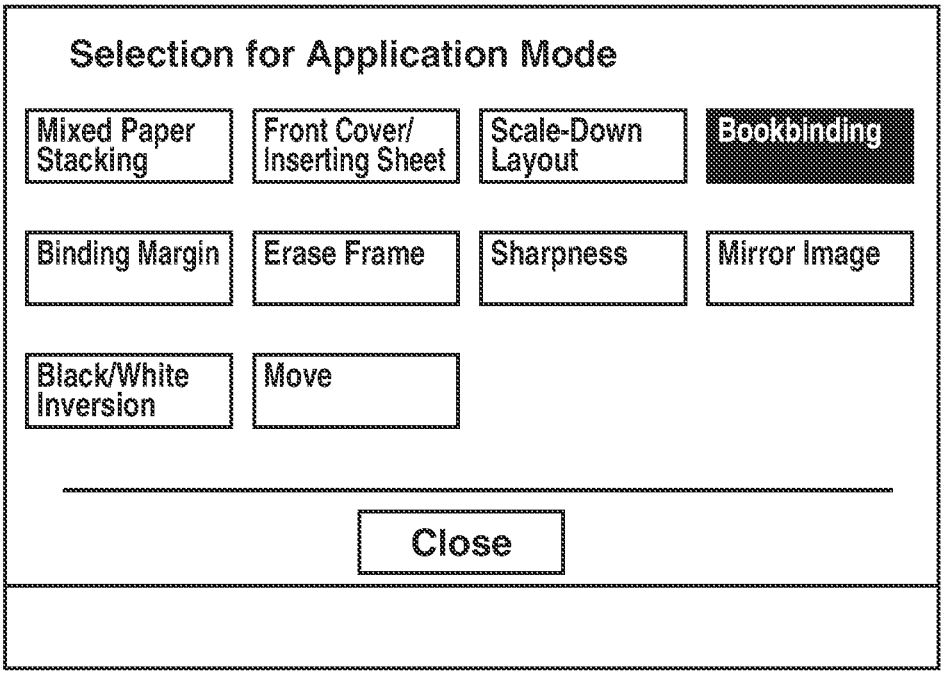
Figure 7C:
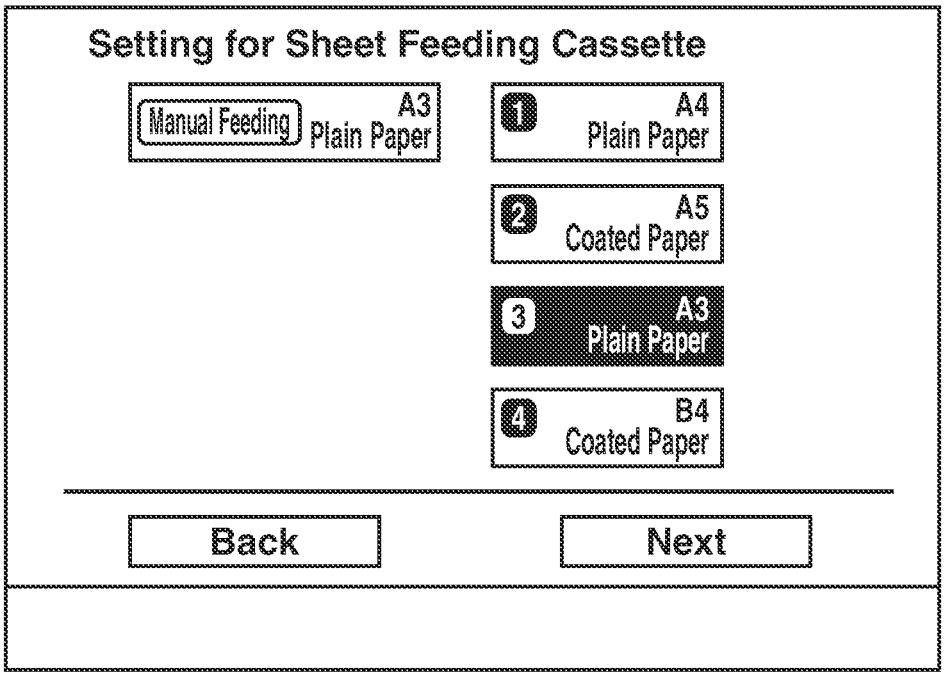

In a case where "bookbinding" is selected by the user in the application mode selecting screen illustrated in FIG. 7B, the display in the operation unit 400 changes to a sheet feeding cassette selecting screen illustrated in FIG. 7C. When a "close" key is pressed by the user in the application mode selecting screen illustrated in FIG. 7B, the screen changes to the initial screen illustrated in FIG. 7A.

Figure 7D:
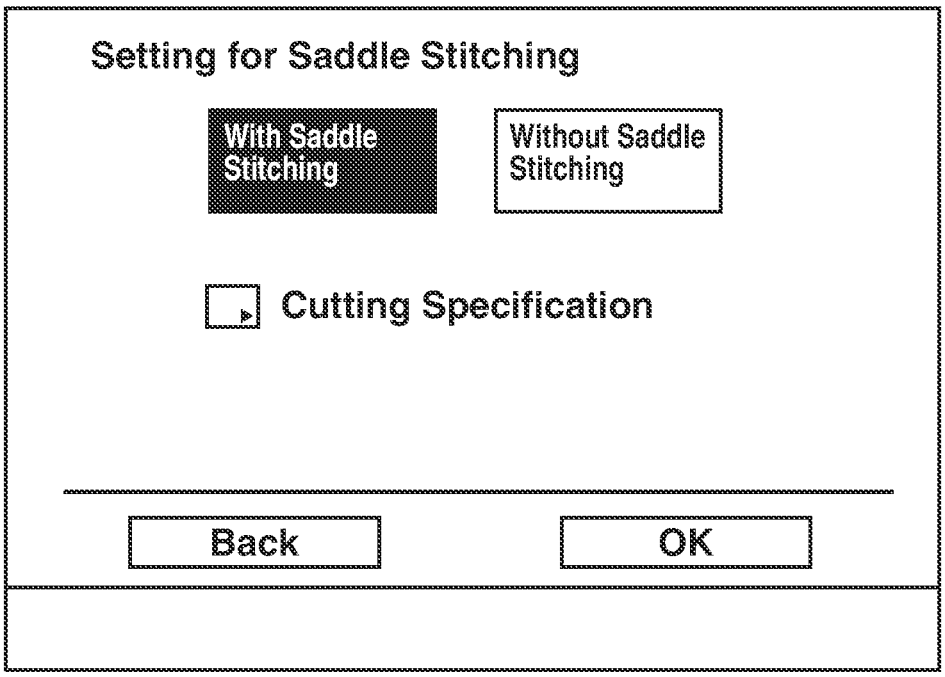
Figure 7E:
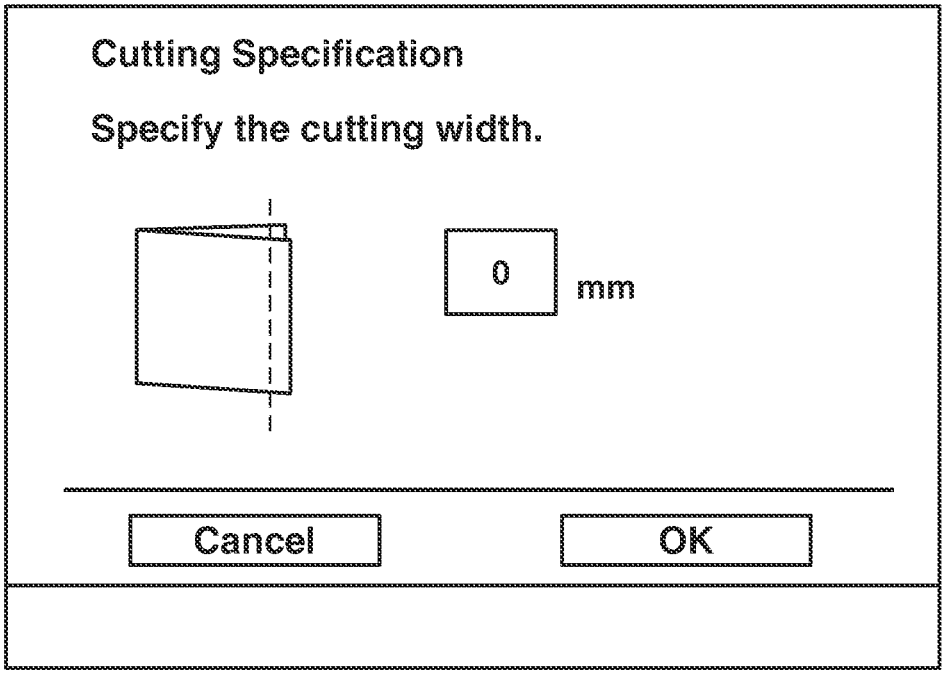

In a case where a sheet feeding cassette is selected by the user in the sheet feeding cassette selecting screen illustrated in FIG. 7C and then a "next" key is pressed, the operation display device control unit 941 changes the screen to a saddle stitching setting screen illustrated in FIG. 7D. In a case where a "back" key is pressed by the user in the sheet feeding cassette selecting screen, the screen changes to the application mode selecting screen illustrated in FIG. 7B.

In a case where a "with saddle stitching" key in the saddle stitching setting screen illustrated in FIG. 7D is selected, a saddle stitching bookbinding mode is set. In a case where bookbinding is to be performed without saddle stitching, the user selects a "without saddle stitching" key. When a soft key indicating "OK" is pressed after either the "without saddle stitching" key or the "with saddle stitching" key is selected, bookbinding mode setting is completed. Further, when a soft key indicating "cutting specification" is pressed on this setting screen, the screen changes to a cutting setting screen illustrated in FIG. 7E.

In the cutting setting, the user sets a cutting amount in the cutting setting screen by using the numeric keypad including the keys 404 to 412 and 414 illustrated in FIG. 4A, and then selects an "OK" key. To cancel the cutting setting, the user selects a "cancel" key. The screen changes to the saddle stitching setting screen (FIG. 7D), when either the "OK" key or the "cancel" key is pressed. When the user presses the start key 402 in FIG. 4A after completion of the bookbinding mode setting, the image forming operation and the bookbinding operation begin.

For example, assume that the user specifies settings as follows. First, a sheet feeding cassette, for which A3 sheets of 80 grams are set, is selected in the sheet feeding cassette selecting screen (FIG. 7C). Next, "with saddle stitching" and "cutting specification" are selected in the saddle stitching setting screen (FIG. 7D). Subsequently, "20" is input in the cutting setting screen (FIG. 7E), and then "OK" is selected. This case will be described as an example. In this case, 420 mm, 297 mm, 80 grams, plain paper, saddle stitching, 20 mm are set as a sheet length, a sheet width, a basis weight, a sheet type, a post processing mode, and a cutting amount, respectively, of the sheet information illustrated in FIG. 2A. This sheet information is to be notified to the finisher 500 by the image forming apparatus 100. In a case where four sheets form one bundle, "bundle leading sheet" is set in bundle leading sheet information in the sheet information of a first sheet, and "bundle last sheet" is set in bundle last sheet information in the sheet information of a fourth sheet.

(Conveyance Operation in Bookbinding Mode)

Figure 8:
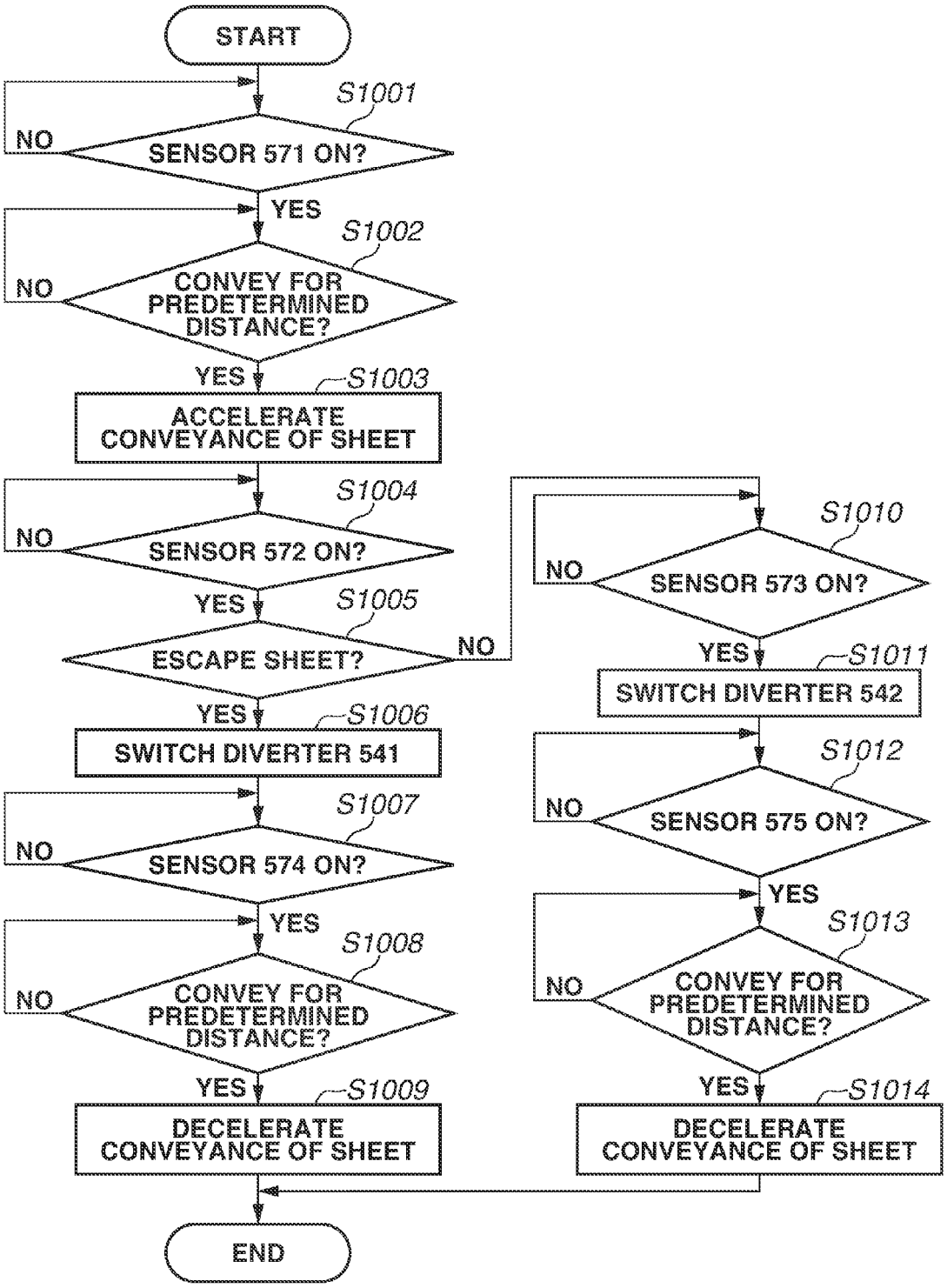
FIG. 8 illustrates sheet conveyance operation in a bookbinding mode.

Sheet conveyance operation to be performed by the CPU 952 of the finisher 500 in the bookbinding mode will be described with reference to a flowchart illustrated in FIG. 8. When passing a sheet to the finisher 500, the image forming apparatus 100 transmits a sheet passing command including a sheet ID to be passed. The flowchart in FIG. 8 beings when the finisher 500 receives the sheet passing command. Processing to be described below is performed by the CPU 952, unless otherwise specified.

First, in step S1001, the CPU 952 determines whether the conveyance sensor 571 is turned on. Here, the CPU 952 waits until the conveyance sensor 571 is turned on. When the conveyance sensor 571 is turned on (YES in step S1001), the processing proceeds to step S1002. In step S1002, the CPU 952 determines whether a sheet P is conveyed for a predetermined distance. When the CPU 952 determines that the sheet P is conveyed for the predetermined distance (YES in step S1002), the processing proceeds to step S1003.

In step S1003, the CPU 952 accelerates the entrance motor M1 and the buffer motor M2, thereby accelerating the conveyance of the sheet by the conveyance roller pairs 512, 513, 514, and 516. The sheet is discharged while being decelerated during stacking. Therefore, the distance between the sheet and the following sheet is reduced. Accelerating here ensures a sufficient distance to the following sheet.

In step S1004, the CPU 952 determines whether the conveyance sensor 572 is turned on. The CPU 952 waits until the conveyance sensor 572 is turned on. When the conveyance sensor 572 is turned on (YES in step S1004), the processing proceeds to step S1005. In step S1005, the CPU 952 determines whether the sheet being conveyed is an escape sheet. In other words, the CPU 952 refers to escape information in the sheet information stored in the RAM 954 as illustrated in FIG. 2B. The sheet information referred to by the CPU 952 corresponds to the sheet ID received with the sheet passing command from the image forming apparatus 100. If "escape" is set in the escape information (YES in step S1005), the processing proceeds to step S1006. If not (NO in step S1005), the processing proceeds to step S1010. Processing for setting "escape" in the escape information will be described in detail below.

In step S1006, the CPU 952 drives the solenoid SL2, thereby switching the diverter 541 to the upper paper ejection path 522 side. In step S1007, the CPU 952 determines whether the conveyance sensor 574 is turned on. The CPU 952 waits until the conveyance sensor 574 is turned on. When the conveyance sensor 574 is turned on (YES in step S1007), the processing proceeds to step S1008.

In step S1008, the CPU 952 determines whether the sheet is conveyed for a predetermined distance. If the CPU 952 determines that the sheet is conveyed for the predetermined distance (YES in step S1008), the processing proceeds to step S1009. In step S1009, the CPU 952 decelerates the buffer motor M2 and the sheet discharge motor M3, thereby reducing the speed of the conveyance of the sheet by the conveyance roller pairs 514 and 515 to a speed for stacking on the upper tray 701. In step S1010, the CPU 952 determines whether the conveyance sensor 573 is turned on. The CPU 952 waits until the conveyance sensor 573 is turned on. When the conveyance sensor 573 is turned on (YES in step S573), the processing proceeds to step S1011.

In step S1011, the CPU 952 drives the solenoid SL3, thereby switching the diverter 542 to the bookbinding path 525 side.

In step S1012, the CPU 952 determines whether the conveyance sensor 575 is turned on. The CPU 952 waits until the conveyance sensor 575 is turned on. When the conveyance sensor 575 is turned on (YES in step S1012), the processing proceeds to step S1013.

In step S1013, the CPU 952 determines whether the sheet P is conveyed for a predetermined distance. When the CPU 952 determines that the sheet P is conveyed for the predetermined distance (YES in step S1013), the processing proceeds to step S1014.

In step S1014, the CPU 952 decelerates the sheet discharge motor M3, thereby reducing the speed of the conveyance of the sheet by the conveyance roller pairs 516 and 517 to the speed for stacking on the saddle stitching tray 860.

(Escape Setting)

A flow, in which the CPU 952 of the finisher 500 performs escape setting for a sheet to be conveyed after occurrence of a paper jam, will be described with reference to a flowchart illustrated in FIG. 9. As described above, the sheet information is transmitted from the CPU 901 of the image forming apparatus 100, and the finisher 500 stores the received sheet information into the RAM 954, in the format illustrated in FIG. 2B. In the present embodiment, the sheet information is stored as a queue so that the sequence of sheets is clear. The sheet information is deleted from the RAM 954 when the sheet is placed in the saddle stitching tray 860 in a case where the bookbinding is performed. Further, the sheet information is deleted from the RAM 954 when the sheet is placed in the upper tray 701 in a case where the escaping is performed. Processing to be described below is executed by the CPU 952, unless otherwise specified.

Figure 9:
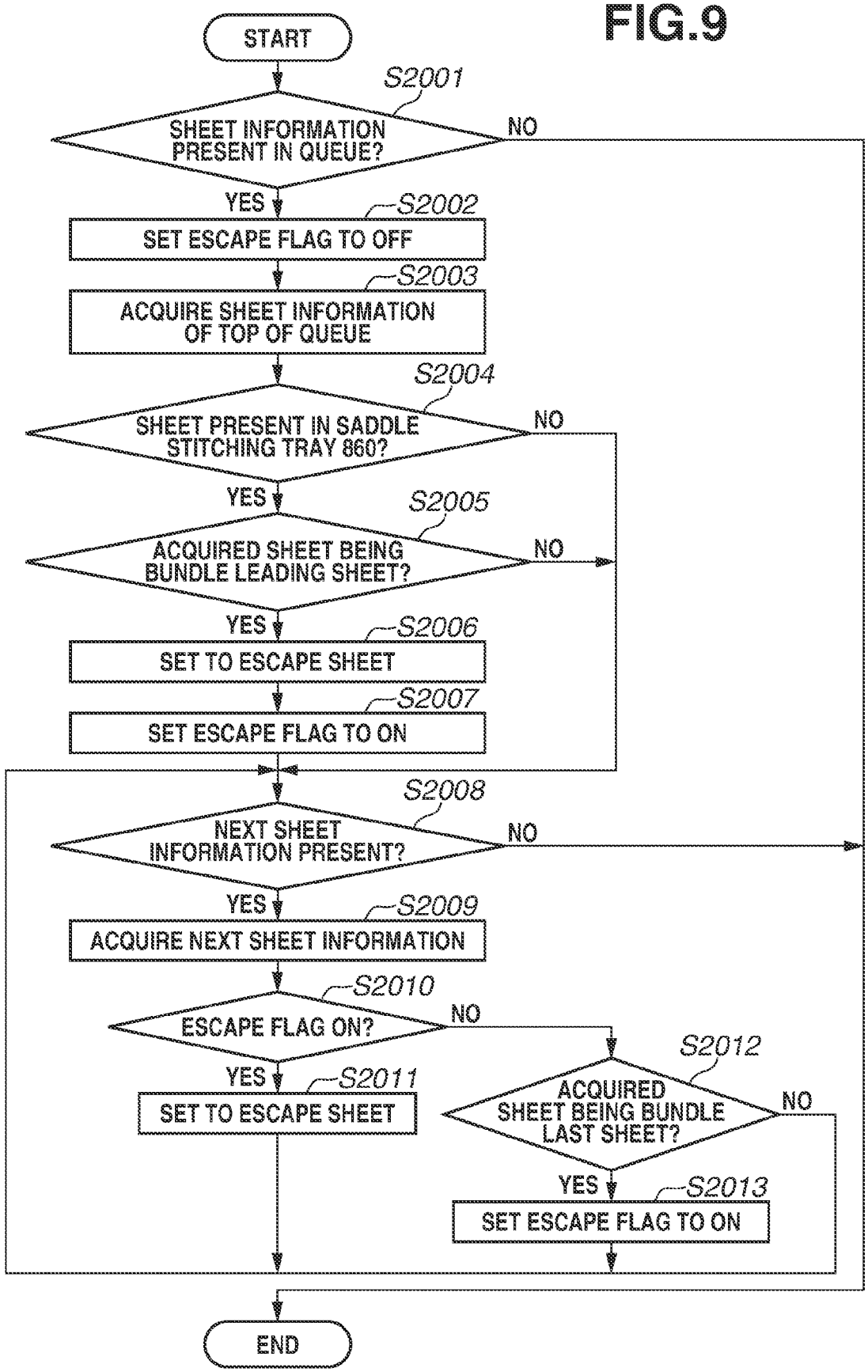
FIG. 9 is a flowchart illustrating operation to be executed when a paper jam occurs.

The flowchart illustrated in FIG. 9 begins when a paper jam occurs in the trimmer. First, in step S2001, the CPU 952 determines whether the sheet information is present in the queue managed on the RAM 954. When the CPU 952 determines that the sheet information is present (YES in step S2001), the processing proceeds to step S2002. When the CPU 952 determines that the sheet information is not present (NO in step S2001), no sheet is to be conveyed after the occurrence of the paper jam. Therefore, the flowchart illustrated in FIG. 9 ends.

In step S2002, the CPU 952 sets an escape flag managed on the RAM 954 to OFF. In step S2003, the CPU 952 acquires the sheet information of the top of the queue, and then the processing proceeds to step S2004. In step S2004, the CPU 952 determines whether a sheet is present in the saddle stitching tray 860, from the logic of the conveyance sensor 871. If the logic of the conveyance sensor 871 corresponds to ON, the CPU 952 determines that a sheet is present (YES in step S2004), and the processing proceeds to step S2005. If the logic of the conveyance sensor 871 corresponds to OFF, the CPU 952 determines that no sheet is present (NO in step S2004), and the processing proceeds to step S2008.

In step S2005, the CPU 952 determines whether the sheet is a bundle leading sheet, based on the acquired sheet information. Specifically, the CPU 952 refers to the bundle leading sheet information in the format of the sheet information illustrated in FIG. 2B, and if "bundle leading sheet" is set, the CPU 952 determines that the sheet is the bundle leading sheet (YES in step S2005). In this case, the processing proceeds to step S2006. In step S2006, the CPU 952 sets "escape" in the escape information in the acquired sheet information of the top of the queue, and stores the result into the RAM 954. For the sheet for which "escape" is set here, the upper tray 701 is determined as a discharging destination. A sheet prior to this sheet is a "bundle last sheet" and already placed in the saddle stitching tray 860. Therefore, if this sheet is conveyed to the saddle stitching tray 860, this sheet is mixed with sheets forming the previous bundle. When the CPU 952 determines that the sheet is not the bundle leading sheet (NO in step S2005), the saddle stitching tray 860 is determined as a discharging destination, and the processing proceeds to step S2008.

In step S2007, the CPU 952 sets the escape flag managed on the RAM 954 to ON, and stores the result into the RAM 954. In step S2008, the CPU 952 determines whether the next sheet information is present in the queue managed on the RAM 954. When the next sheet information is present (YES in step S2008), the processing proceeds to step S2009. When the next sheet information is not present (NO in step S2008), the escape setting ends.

In step S2009, the CPU 952 acquires the next sheet information from the RAM 954, and the processing proceeds to step S2010. In step S2010, the CPU 952 refers to the escape flag managed on the RAM 954 to determine whether the escape flag is ON. If the escape flag is ON (YES in step S2010), the processing proceeds to step S2011. If the escape flag is OFF (NO in step S2010), the processing proceeds to step S2012.

In step S2011, the CPU 952 sets "escape" in the escape information in the acquired sheet information, and stores the result in the RAM 954. The processing then proceeds to step S2008. In step S2012, the CPU 952 determines whether the acquired sheet is a bundle last sheet. Specifically, the CPU 952 refers to the bundle last sheet information in the format of the sheet information illustrated in FIG. 2B. If "bundle last sheet" is set (YES in step S2012), the processing proceeds to step S2013. In step S2013, the CPU 952 sets the escape flag managed on the RAM 954 to ON, and stores the result into the RAM 954. If "bundle last sheet" is not set (NO in step S2012), the processing proceeds to step S2008. If "bundle last sheet" is set, this sheet is the last sheet of the same sheet bundle as that of the previous sheet. This sheet is to be conveyed to the saddle stitching tray 860, without escaping. Therefore, the CPU 952 does not set "escape". For a sheet after this bundle last sheet (i.e., the bundle leading sheet of the next bundle), it is necessary to set "escape", and therefore, the CPU 952 sets the escape flag to ON.

Figure 10A:
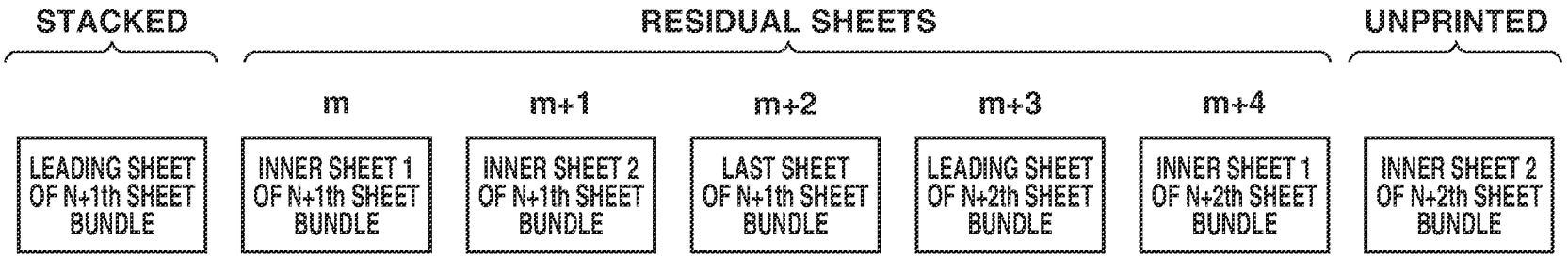
FIGS. 10A and 10B each illustrate examples of a remaining sheet when a paper jam occurs.

FIG. 10A illustrates an example of a case where a paper jam occurs during the cutting operation for a sheet bundle N. In FIG. 10A, the leading sheet of an N+1th sheet bundle is already placed in the saddle stitching tray 860. An inner sheet 1 (a sheet m) and an inner sheet 2 (a sheet m+1) of the N+1th sheet bundle as well as the last sheet (a sheet m+2) of the N+1th sheet bundle are remaining sheets on each of which an image is formed. Similarly, the leading sheet (a sheet m+3) of an N+2th sheet bundle and an inner sheet 1 (a sheet m+4) of the N+2th sheet bundle are also remaining sheets. An inner sheet 2 of the N+2th sheet bundle is a sheet on which an image has not been formed yet. In the example illustrated in FIG. 10A, "escape" is set in the escape information included in the sheet information of each of the leading sheet (the sheet m+3) of the N+2th sheet bundle and the inner sheet 1 (the sheet m+4) of the N+2th sheet bundle. Therefore, the sheets m, m+1, and m+2 of the sheet bundle N+1 are stacked in the saddle stitching tray 860, and the sheets m+3 and m+4 are stacked in the upper tray 701. Only the sheets of the sheet bundle N+1 are stacked in the saddle stitching tray 860. Therefore, the sheets of the sheet bundle N+1 are not mixed with sheets of other sheet bundles.

Figure 10B:
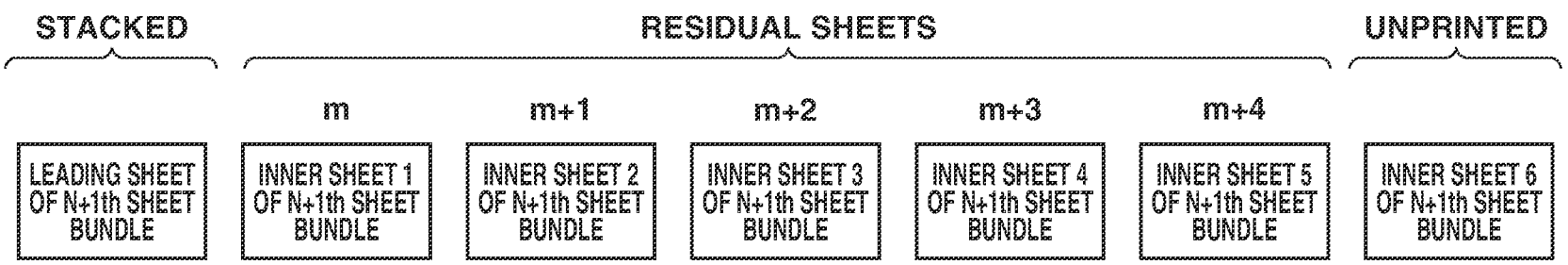

Similarly, FIG. 10B illustrates an example of a case where a paper jam occurs during the cutting operation for a sheet bundle N. A point different from FIG. 10A is that all the remaining sheets are sheets of an N+1th sheet bundle. In this case, sheets m to m+4 are all stacked in the saddle stitching tray 860, and reprinting of the sheets m to m+4 is unnecessary.

(First Operation in Job Resumption)

Figure 11:
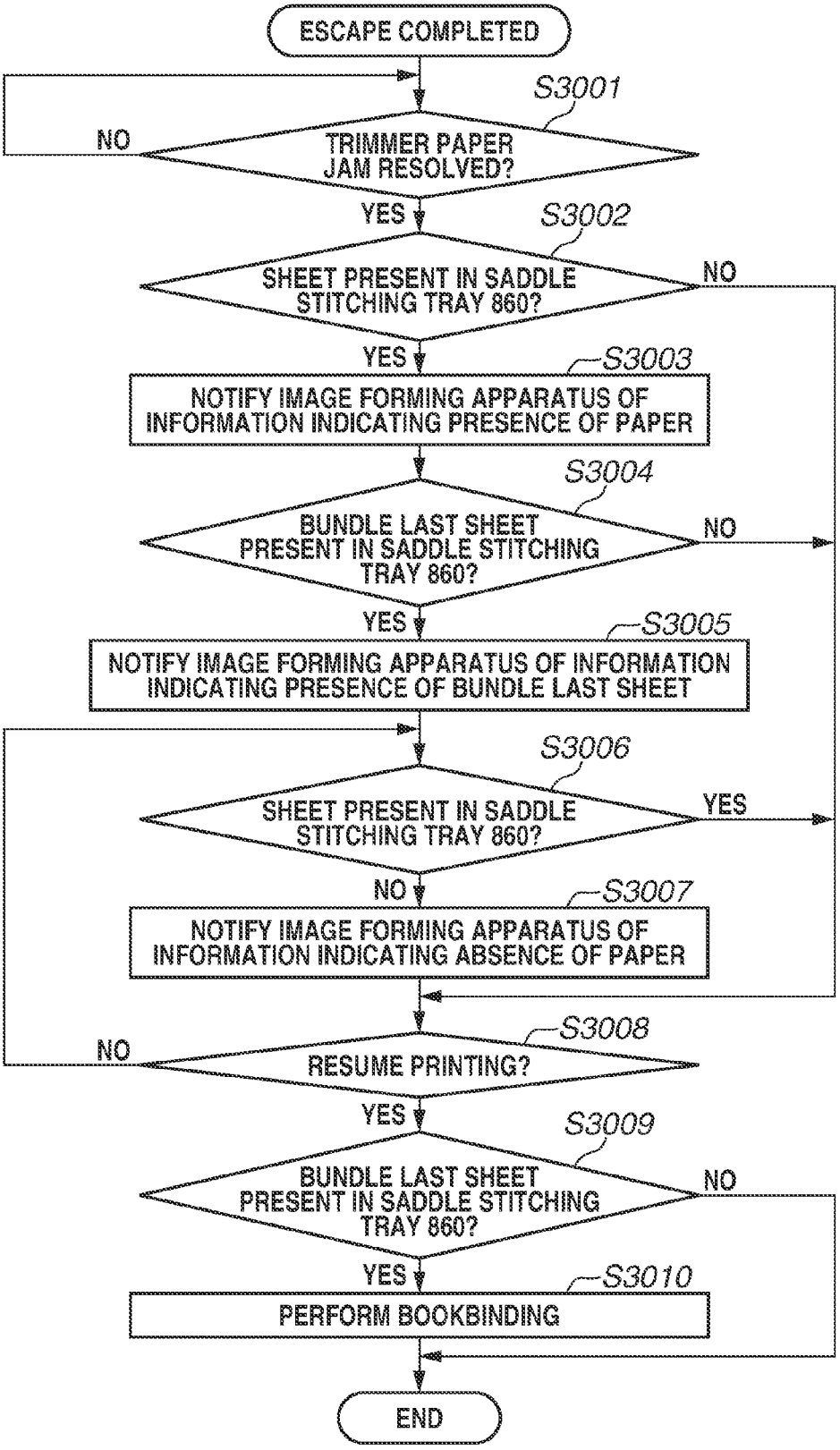
FIG. 11 is a flowchart illustrating operation to be executed when a paper jam is cleared.

FIG. 11 is a flowchart illustrating operation when the CPU 952 of the finisher 500 resumes a job after a paper jam is cleared. Processing to be described below is performed by the CPU 952, unless otherwise specified.

In step S3001, the CPU 952 determines whether a paper jam in the trimmer is cleared. The CPU 952 waits until the paper jam in the trimmer is cleared. Specifically, the CPU 952 confirms detection information from the conveyance sensors 874, 875, and 876, thereby determining whether these sensors are all OFF. When the paper jam in the trimmer is cleared (YES in step S3001), the processing proceeds to step S3002.

In step S3002, the CPU 952 determines whether a sheet is present in the saddle stitching tray 860, from detection information of the conveyance sensor 871 provided at the saddle stitching tray 860. When the conveyance sensor 871 is ON, the CPU 952 determines that at least one sheet is present in the saddle stitching tray 860 (YES in step S3002), and then the processing proceeds to step S3003.

On the other hand, when the conveyance sensor 871 is OFF, the CPU 952 determines that no sheet is preset in the saddle stitching tray 860 (NO in step S3002), and then the processing proceeds to step S3008.

In step S3003, the CPU 952 notifies the image forming apparatus 100 of information indicating presence of paper. The information indicating presence of paper is information indicating that a sheet is present in the saddle stitching tray 860. Upon receipt of the information indicating presence of paper, the image forming apparatus 100 displays a screen illustrated in FIG. 12, in the operation unit 400. FIG. 12 illustrates an example of a screen for providing an instruction for resumption of printing after a paper jam is cleared. When a "resume" button is selected by the user on this screen, the printing resumes in the image forming apparatus 100.

In step S3004, the CPU 952 determines whether a bundle last sheet is present in the saddle stitching tray 860. In a case where the bundle last sheet is present (YES in step S3004), the processing proceeds to step S3005. In a case where the bundle last sheet is not present (NO in step S3004), the processing proceeds to step S3008. The case where the bundle last sheet is present is a case where sheets of one bundle are stacked in the saddle stitching tray 860. In other words, this case corresponds to the example illustrated in FIG. 10A. On the other hand, the case where the bundle last sheet is not present is a case where sheets of one bundle are not stacked in the saddle stitching tray 860. In other words, this is a case where sheets supposed to form the same bundle include at least one unprinted sheet. This case corresponds to the example illustrated in FIG. 10B.

In step S3005, the CPU 952 notifies the image forming apparatus 100 of information indicating presence of bundle last sheet, and then the processing proceeds to step S3006.

When receiving the information indicating presence of bundle last sheet, the image forming apparatus 100 determines that it is not necessary to reprint the sheet bundle stacked in the saddle stitching tray 860. On the other hand, when not receiving the information indicating presence of bundle last sheet, the image forming apparatus 100 determines that it is necessary to print an unprinted page of the same bundle.

In step S3006, the CPU 952 determines whether a sheet is present in the saddle stitching tray 860, from the detection information of the conveyance sensor 871 provided at the saddle stitching tray 860. This determination is made because there is a possibility that the user may have removed sheets in the saddle stitching tray 860 after the screen illustrated in FIG. 12 is displayed.

When the conveyance sensor 871 is OFF, the CPU 952 determines that a sheet bundle in the saddle stitching tray 860 is removed by the user (NO in step S3006), and then the processing proceeds to step S3007. When the conveyance sensor 871 is ON, the CPU 952 determines that the sheet bundle in the saddle stitching tray 860 is not removed by the user (YES in step S3006), and then the processing proceeds to step S3008.

It step S3007, the CPU 952 notifies the image forming apparatus 100 of information indicating absence of paper. The processing then proceeds to step S3008. The information indicating absence of paper indicates that no sheet is present in the saddle stitching tray 860. In step S3008, the CPU 952 determines whether printing is resumed. The CPU 952 waits until the printing is resumed. In other words, the CPU 952 waits until the user presses "resume" in the image illustrated in FIG. 12 displayed in the operation unit 400.

When the printing is resumed (YES in step S3008), the image forming apparatus 100 changes sheets to be subjected to the resumption of printing, according to a stacking state of the saddle stitching tray 860, at the time of the resumption. This will be described in detail below.

Described below is, for example, a case of executing a job for forming an image on a sheet, and forming M-number of sheet bundles using sheets on each of which the image is formed, and further performing the post processing for the M-number of sheet bundles. Assume that a paper jam occurs in cutting operation for a sheet bundle N, during execution of this job. In this case, according to the present embodiment, sheets of an N+1th sheet bundle are stacked in the saddle stitching tray 860, and sheets of an N+2th sheet bundle and thereafter are discharged to the upper tray 701. Here, assume that all the sheets of the N+1th sheet bundle are stacked in the saddle stitching tray 860. Further, assume that the N+1th sheet bundle stacked in the saddle stitching tray 860 is not removed by the user during jam clearing. If printing is resumed in this state, the image forming apparatus 100 prints the sheets of the N+2th sheet bundle, without printing the sheets of the N+1th sheet bundle (the sheets already stacked in the saddle stitching tray 860), after printing sheets (jammed sheet) of an Nth sheet bundle. In other words, the image forming apparatus 100 causes the image forming unit to form an image on each of sheets forming M−N−1 bundles. In the stacking tray 702 after the resumption of printing, the sheet bundles are stacked in the order of a sheet bundle N−1, a sheet bundle N+1, the sheet bundle N, a sheet bundle N+2, and so on. The image forming apparatus 100 determines pages to be printed, based on the information indicating presence of paper, and the bundle last sheet information received from the finisher 500.

Another example will be described. Described below is, for example, a case of executing a job for forming an image on a sheet, and forming M-number of sheet bundles using sheets on each of which the image is formed, and further performing the post processing for the M-number of sheet bundles, as in the above-described example. In the above-described example, all the sheets of the N+1th sheet bundle are stacked in the saddle stitching tray 860. In this example, however, the N+1th sheet bundle is assumed to be removed in jam clearing. In a case where printing is resumed in a state that the sheet bundle is removed from the saddle stitching tray 860, the image forming apparatus 100 prints the sheets, in the order of the sheets of the Nth sheet bundle, the sheets of the N+1th sheet bundle, and the sheets of the N+2th sheet bundle. The sheets of the N+1th sheet bundle are also printed, because these sheets are stacked in the saddle stitching tray 860 at the occurrence of a paper jam, but removed in the jam clearing. After the resumption of printing, the sheets are stacked in the stacking tray 702, in the order of the N−1th sheet bundle, the Nth sheet bundle, the N+1th sheet bundle, the N+2th sheet bundle, . . . , and an Mth sheet bundle.

Yet another example will be described. Described below is, for example, a case of executing a job for forming an image on a sheet, and forming M-number of sheet bundles using sheets on each of which the image is formed, and further performing the post processing for the M-number of sheet bundles, as in the above-described example. In this example, when a paper jam occurs in cutting operation of the sheet bundle N, only part of the N+1th sheet bundle is assumed to be stacked in the saddle stitching tray 860, and the remaining sheets of the N+1th sheet bundle are assumed to be unprinted. In other words, not all the sheets of the N+1th sheet bundle are assumed to be stacked in the saddle stitching tray 860. In a case where printing is resumed in this state, the image forming apparatus 100 prints the sheets in the order of the Nth sheet bundle, an unprinted sheet of the N+1th sheet bundle, the N+2th sheet bundle, . . . , and the Mth sheet bundle.

In step S3009, the CPU 952 determines whether a bundle last sheet is present in the saddle stitching tray 860. If the bundle last sheet is present (YES in step S3009), the processing proceeds to step S3010. If the bundle last sheet is not present (NO in step S3009), the flowchart in FIG. 11 ends.

In step S3010, the CPU 952 executes the post processing, for the N+1th sheet bundle, which is stacked in the saddle stitching tray 860 before the paper jam is cleared. Specifically, the CPU 952 causes the saddle stapler 820*a* to perform stapling, the folding roller pair 810 and the thrust member 830 to perform folding, the saddle press 840 to perform sheet pressing, and the trimmer to perform cutting.

As described above, according to the first embodiment, in a case where a paper jam occurs in the cutting unit, sheets remaining upstream from the saddle stitching tray 860 in the conveyance direction are discharged to different discharging destinations (the saddle stitching tray 860 and the upper tray 701) as described above. Specifically, a sheet of the same bundle as that of sheets already stacked in the saddle stitching tray 860 is discharged to the saddle stitching tray 860, and a sheet of a different bundle is discharged to the upper tray 701. Therefore, the sheet to be included in the different bundle is prevented from being mixed with the sheets stacked in the saddle stitching tray 860. Further, sheets to be reprinted after a paper jam is cleared can be reduced, which can reduce waste sheets and toner.

(Second Operation in Job Resumption)

Figure 13:
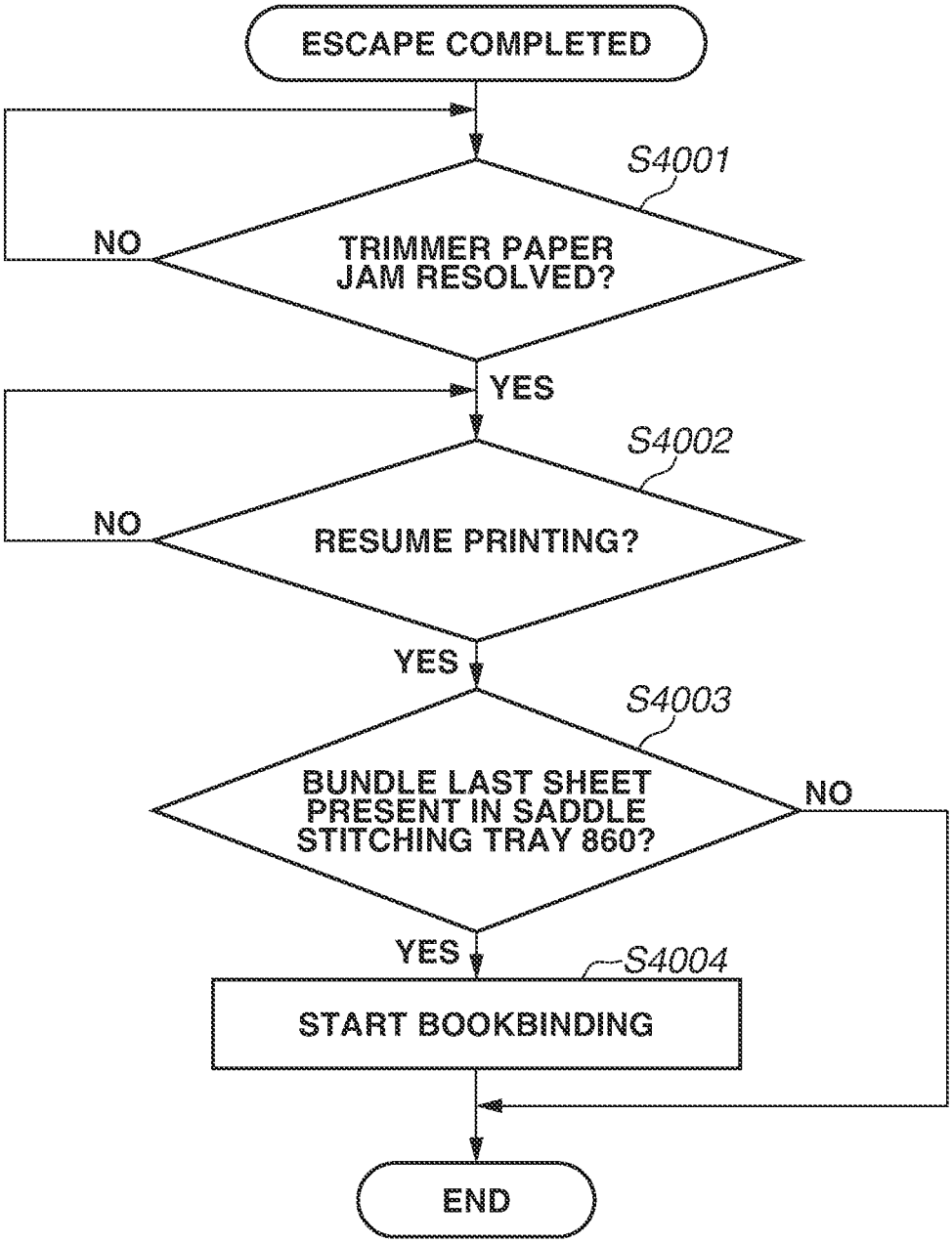
FIG. 13 is a flowchart illustrating operation to be executed when a paper jam is cleared, according to a second embodiment.

FIG. 13 is a flowchart illustrating operation in job resumption, according to a second embodiment. Each step of the flowchart in FIG. 13 is processing to be performed by the CPU 952 of the finisher 500, unless otherwise specified.

Figure 14:
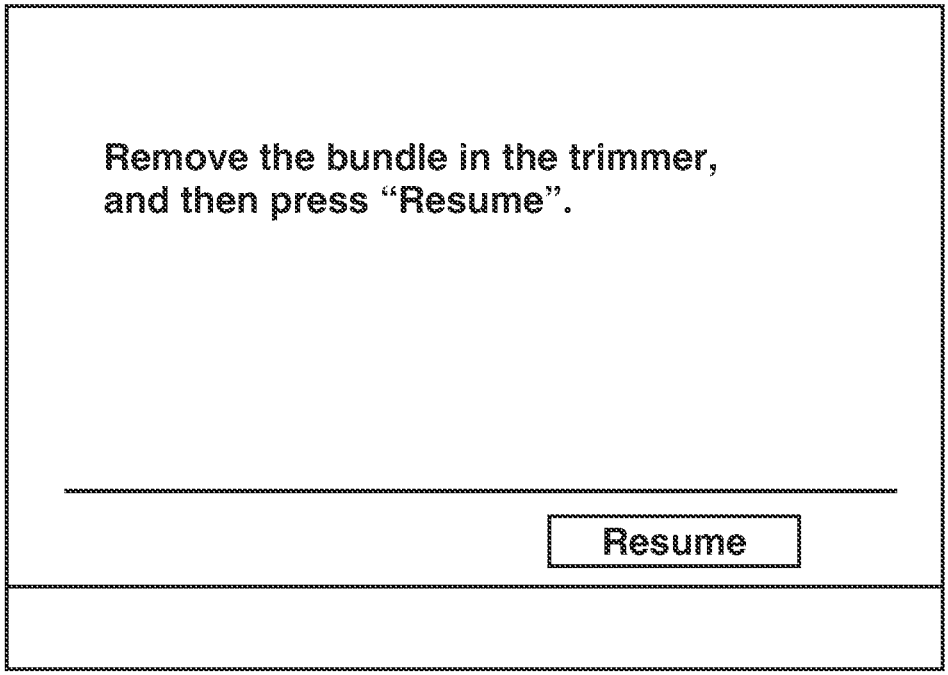
FIG. 14 illustrates a display screen of an operation display device, according to the second embodiment.

First, in step S4001, the CPU 952 determines whether a paper jam of the trimmer is cleared. The CPU 952 waits until the paper jam of the trimmer is cleared. In other words, the CPU 952 determines whether the conveyance sensors 874, 875, and 876 are all OFF. When the paper jam of the trimmer is cleared (YES in step S4001), the processing proceeds to step S4002. In step S4002, the CPU 952 determines whether printing is resumed. The CPU 952 waits until the printing is resumed. In other words, the CPU 952 waits until the user presses "resume" in an image illustrated in FIG. 14, which is displayed in the operation unit 400.

In step S4003, the CPU 952 determines whether a bundle last sheet is present in the saddle stitching tray 860. If the bundle last sheet is present (YES in step S4003), the processing proceeds to step S4004. If the bundle last sheet is not present (NO in step S4003), the flow ends.

In step S4004, the CPU 952 performs bookbinding for a sheet bundle stacked in the saddle stitching tray 860. Specifically, the CPU 952 causes the saddle stapler 820*a* to perform the stapling, the folding roller pair 810 and the thrust member 830 to perform the folding, the saddle press 840 to perform the sheet pressing, and the folding conveyance roller pairs 811 and 812 to convey the sheet bundle to the trimmer.

In the present embodiment, the printing is resumed when the user presses "resume" in the operation unit 400. However, printing may be automatically resumed when a paper jam is cleared.

For example, assume that, when a paper jam occurs in cutting operation of a sheet bundle N, the leading sheet of a sheet bundle N+1 is already placed in the saddle stitching tray 860 as in FIG. 10A, and sheets of the sheet bundle N+1 and sheets of a sheet bundle N+2 are mixed as remaining sheets. In this case, the sheets m, m+1, and m+2 of the sheet bundle N+1 are stacked in the saddle stitching tray 860, whereas the sheets m+3 and m+4 of the sheet bundle N+1 are stacked in the upper tray 701, as described above. Further, in resumption of printing, bookbinding of the sheet bundle N+1 is performed, and the printing is resumed from the leading sheet of the sheet bundle N.

Further, for example, assume that, when a paper jam occurs in cutting operation of a sheet bundle N, the leading sheet of the sheet bundle N+1 is already placed in the saddle stitching tray 860, and all the remaining sheets are sheets of the sheet bundle N+1, as in FIG. 10B. In this case, the sheets m to m+4 are all stacked in the saddle stitching tray 860. In resumption of printing, the printing is resumed starting from the next page of the sheet bundle N+1 (an image to be formed on an inner sheet 6 of the sheet bundle N+1).

As described above, according to the present embodiment, in a case where a paper jam occurs in the cutting unit, sheets remaining upstream from the saddle stitching tray 860 in the conveyance direction are discharged to different discharging destinations (the saddle stitching tray 860 and the upper tray 701). Specifically, a sheet of the same bundle as that of sheets already stacked in the saddle stitching tray 860 is discharged to the saddle stitching tray 860, and a sheet of a different bundle is discharged to the upper tray 701. In other words, the conveyance of sheets of a bundle to the saddle stitching tray 860 continues until the last sheet of the bundle is conveyed, and sheets of the next bundle including the leading sheet thereof are conveyed to a tray other than the saddle stitching tray 860. This can reduce waste sheets and toner. Moreover, a sheet to be included in a different bundle can be prevented from being mixed with the sheets in the saddle stitching tray 860.

Embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-156768, filed Aug. 9, 2016, which is hereby incorporated by reference herein in its entirety.

What is claimed is:

1. An image forming apparatus comprising:

an image forming unit configured to form an image on a sheet;

a first conveyance path for conveying the sheet on which the image is formed by the image forming unit;

an intermediate processing tray in which a plurality of sheets conveyed through the first conveyance path is stacked as a sheet bundle;

a bookbinding unit configured to execute bookbinding for the sheet bundle stacked in the intermediate processing tray;

a second conveyance path for conveying the sheet bundle after the bookbinding is performed for the sheet bundle by the bookbinding unit;

a cutting unit configured to cut the sheet bundle conveyed in the second conveyance path;

a sensor disposed at the second conveyance path and configured to detect a sheet bundle being conveyed in the second conveyance path;

a stacking tray in which sheets discharged through a discharging path diverging from the first conveyance path are stacked; and a control unit configured to determine a discharging destination of sheets remaining in the first conveyance path, wherein, in response to occurrence of a paper jam based on detection information from the sensor, the control unit determines the intermediate processing tray as the discharging destination, for a sheet to be included in a same bundle as a bundle of sheets stacked in the intermediate processing tray among the remaining sheets, and determines the stacking tray as the discharging destination, for a sheet to be included in a bundle different from the bundle of the sheets stacked in the intermediate processing tray among the remaining sheets, and wherein, after the paper jam is cleared, the control unit causes execution of bookbinding and cutting for a sheet bundle including the remaining sheets stacked in the intermediate processing tray.

2. The image forming apparatus according to claim 1 wherein, in a case where a job for forming an image on a sheet, for forming M-number of sheet bundles of a plurality of sheets on each of which an image is formed, and for performing post processing for the M-number of sheet bundles is to be executed, and where a paper jam occurs during conveyance of an Nth sheet bundle in the second conveyance path, the post processing is performed for an N+1th sheet bundle after the paper jam is cleared, wherein the N+1th sheet bundle is stacked in the intermediate processing tray before the paper jam is cleared.

3. The image forming apparatus according to claim 2, wherein, after the paper jam is cleared, the control unit causes the image forming unit to form an image on each of sheets of M−N−1 sheet bundles.

4. The image forming apparatus according to claim 2, wherein the control unit is configured to determine whether all the sheets of the N+1th sheet bundle are present in the intermediate processing tray, and wherein, in a case where the control unit determines that not all the sheets of the N+1th sheet bundle are present, the control unit causes the image forming unit to perform image formation for a remaining sheet of the N+1th sheet bundle.

5. The image forming apparatus according to claim 2, wherein the sensor is a first sensor, the image forming apparatus further comprising a second sensor provided at the intermediate processing tray, wherein, in a case where the paper jam is cleared and where, based on detection information from the second sensor, the control unit determines that the N+1th sheet bundle stacked in the intermediate processing tray is removed after occurrence of the paper jam, the control unit controls the image forming unit to form an image on each of sheets of M−N sheet bundles after the paper jam is cleared.

6. The image forming apparatus according to claim 2, further comprising a display unit, wherein, in a case where the paper jam is cleared, the control unit causes the display unit to display presence of a sheet of the N+1th sheet bundle in the intermediate processing tray.

7. A sheet processing apparatus comprising:

a first conveyance path for conveying a sheet on which an image is formed by an image forming unit;

an intermediate processing tray in which a plurality of sheets conveyed through the first conveyance path is stacked as a sheet bundle;

a bookbinding unit configured to execute bookbinding for the sheet bundle stacked in the intermediate processing tray;

a second conveyance path for conveying the sheet bundle after the bookbinding is performed for the sheet bundle by the bookbinding unit;

a cutting unit configured to cut the sheet bundle conveyed in the second conveyance path;

a sensor disposed at the second conveyance path and configured to detect a sheet bundle being conveyed in the second conveyance path;

a stacking tray in which sheets discharged through a discharging path diverging from the first conveyance path are stacked; and a control unit configured to determine a discharging destination of sheets remaining in the first conveyance path, wherein, in response to occurrence of a paper jam based on detection information from the sensor, the control unit determines the intermediate processing tray as the discharging destination, for a sheet to be included in a same bundle as a bundle of sheets stacked in the intermediate processing tray among the remaining sheets, and determines the stacking tray as the discharging destination, for a sheet to be included in a bundle different from the bundle of the sheets stacked in the intermediate processing tray among the remaining sheets, and wherein, after the paper jam is cleared, the control unit causes execution of bookbinding and cutting for a sheet bundle including the remaining sheets stacked in the intermediate processing tray.

* * * * *